US008371727B2

(12) United States Patent
Dreeben et al.

(10) Patent No.: US 8,371,727 B2
(45) Date of Patent: Feb. 12, 2013

(54) PARTIALLY RECESSED LUMINAIRE

(75) Inventors: Thomas D. Dreeben, Swampscott, MA (US); James A. Gotay, Lowell, MA (US)

(73) Assignee: Osram Sylvania Inc., Danvers, MA (US)

( * ) Notice: Subject to any disclaimer, the term of this patent is extended or adjusted under 35 U.S.C. 154(b) by 190 days.

(21) Appl. No.: 13/076,141

(22) Filed: Mar. 30, 2011

(65) Prior Publication Data

US 2012/0250299 A1 Oct. 4, 2012

(51) Int. Cl.
*F21V 17/00* (2006.01)

(52) U.S. Cl. ..... 362/364; 362/365; 362/311.01; 362/373; 362/218

(58) Field of Classification Search ..... 362/311.01–311.15, 345, 373, 362/547, 364–366, 190, 290, 246
See application file for complete search history.

(56) References Cited

U.S. PATENT DOCUMENTS

| | | | | |
|---|---|---|---|---|
| 4,754,377 | A * | 6/1988 | Wenman | 362/364 |
| 4,930,054 | A * | 5/1990 | Krebs | 362/276 |
| 5,567,041 | A * | 10/1996 | Slocum | 362/365 |
| 5,738,436 | A | 4/1998 | Cummings et al. | |
| 5,826,970 | A | 10/1998 | Keller et al. | |
| 7,670,021 | B2 | 3/2010 | Chou | |
| 7,722,227 | B2 | 5/2010 | Zhang et al. | |
| D624,691 | S | 9/2010 | Zhang et al. | |
| 2008/0112170 | A1 | 5/2008 | Trott et al. | |
| 2010/0061108 | A1 | 3/2010 | Zhang et al. | |
| 2010/0110699 | A1 | 5/2010 | Chou | |
| 2011/0026245 | A1 | 2/2011 | Lau | |
| 2012/0140470 | A1 * | 6/2012 | Soo et al. | 362/246 |

FOREIGN PATENT DOCUMENTS

| | | | |
|---|---|---|---|
| EP | 2280213 | A2 | 2/2011 |
| WO | WO2007/130536 | A2 | 11/2007 |

OTHER PUBLICATIONS

International Search Report mailed on Jun. 25, 2012 for Application PCT/US2012/030655 filed Mar. 27, 2012.

S.H. Jang and M.W. Shi, Thermal analysis of LED arrays for automotive headlamp with novel cooling system, IEEE Transactions on Device and Materials Reliability, 8(3), p. 561-564, 2008.

A. Christenson, H. Minseok, S. Graham, Thermal Management Methods for Compact High Power LED Arrays, Seventh International Conference on Solid State Lighting, Proc. Of SPIE 6669, 66690Z, 2007.

T. Dong and H. Narendran, Understanding heat transfer mechanisms in recessed LED luminaires, Ninth International Conference on Solid State Lighting, Proc. Of SPIE 7422, 74220V, 2009.

(Continued)

*Primary Examiner* — Mariceli Santiago
(74) *Attorney, Agent, or Firm* — Robert F. Clark; Andrew Martin

(57) ABSTRACT

A rectangular luminaire includes a rectangular fixture defining at least one cavity having a plurality of light engines. A heat flange is disposed about a distal end region of the rectangular fixture and includes a hollow, generally pyramidal frustum shape with a generally rectangular cross-section. A distal-most end of the heat flange is configured to be disposed a distance D from a support surface when the rectangular fixture is received in a recess of the support surface, the distance D being greater than or equal to 0.4 times the fixture half-width W. Thermal energy is conductively transferred from the light engine, through the rectangular fixture, to the heat flange where the thermal energy is convectively transferred from the heat flange to surrounding air to create air currents flowing along the support surface thereby reducing the junction temperature.

20 Claims, 20 Drawing Sheets

OTHER PUBLICATIONS

J. Concepcion, Passive heatsinking for Recessed Luminaires, Master's thesis, Lighting Research Center, Rensselaer Polytechnic Institute, 2004.

International Search Report mailed on Jun. 15, 2012 for Application PCT/US2012/029839 filed Mar. 20, 2012.

* cited by examiner

PARTIALLY RECESSED LUMINAIRE

CROSS-REFERENCE TO RELATED APPLICATIONS

This application is related to copending application, U.S. patent application Ser. No. 13/076,118, PARTIALLY RECESSED LUMINAIRE, filed simultaneously herewith, the entire disclosure of which is incorporated herein by reference.

TECHNICAL FIELD

The present disclosure relates to luminaires, and more particularly pertains to luminaires and methods for reducing the junction temperature of a light engine.

BACKGROUND

Luminaires, such as down lights or the like, may include a can and a light engine disposed within a cavity defined by the can. The light engine includes a light source configured to generate light. One such type of light source includes light emitting diodes, LEDs. While LEDs may generate less thermal energy compared to traditional bulbs (e.g., incandescent light bulbs), LEDs nevertheless generate thermal energy which should be managed in order to control the junction temperature. A higher junction temperature generally correlates to lower light output, lower luminaire efficiency, and/or reduced life expectancy. Unfortunately, managing thermal energy is particularly challenging when designing ceiling fixtures because temperature gradients in a room send the hottest air closest to the ceiling. Moreover, thermal insulation installed in the ceiling, and particularly proximate to the ceiling fixture, may reduce and/or suppresses natural convection. For example, the thermal insulation may have a thermal conductivity of approximately 0.04 W/(m-K), and as a result, the thermal insulation may generally only permit the removal of thermal energy upward from the ceiling fixture by thermal conduction which occurs at a far slower rate than thermal convection above the ceiling.

Another challenge facing the design of ceiling fixtures involves a plurality of ceiling fixtures installed throughout a room. In particular, the ceiling fixtures which are surrounded by other ceiling fixtures (e.g., ceiling fixtures in the middle of the room) are most vulnerable to overheating as they are farthest from the walls (which may help to act as a heat sink). Moreover, nearby ceiling fixtures generate thermal energy which reduces and/or minimizes any lateral temperature gradient across the ceiling. As a result, thermal energy is generally limited to upward and downward. Because hot air rises, most of the thermal energy must travel through the insulated ceiling.

BRIEF DESCRIPTION OF THE DRAWINGS

Features and advantage of the claimed subject matter will be apparent from the following description of embodiments consistent therewith, which description should be considered in conjunction with the accompanying drawings, wherein:

DETAILED DESCRIPTION

By way of an overview, one aspect consistent with the present disclosure may feature a luminaire including a fixture, a light engine coupled to the fixture, and a heat flange configured to extend outwardly beyond the mounting surface of the luminaire. The heat flange reduces the junction temperature of the light engine by increasing the amount of convection in the surrounding air, thereby increasing the volumetric air flow across the fixture as well as the air velocity. As used herein, the term "junction temperature" is intended to refer to the maximum temperature of the light engine when operating at steady state power. In particular, thermal energy is conductively transferred from the light engine, through the fixture, to the heat flange where the thermal energy is convectively transferred from the heat flange to surrounding air to create air currents flowing along the support surface. The increased volumetric air flow and velocity transfers a greater amount of thermal energy from the fixture into the surrounding air, thereby reducing the junction temperature of the light engine. In addition, the shape of the heat flange increases the air velocity across the mounting surface of the luminaire, thereby exposing the heated air to a larger area of the mounting surface, and reducing the temperature difference needed to transfer the thermal energy from the air to the mounting surface. Reducing the junction temperature of the light engine may increase the life expectancy of the light engine and/or may allow the light engine to be operated at a higher luminance while also maintaining an acceptable service life.

Figure 1:
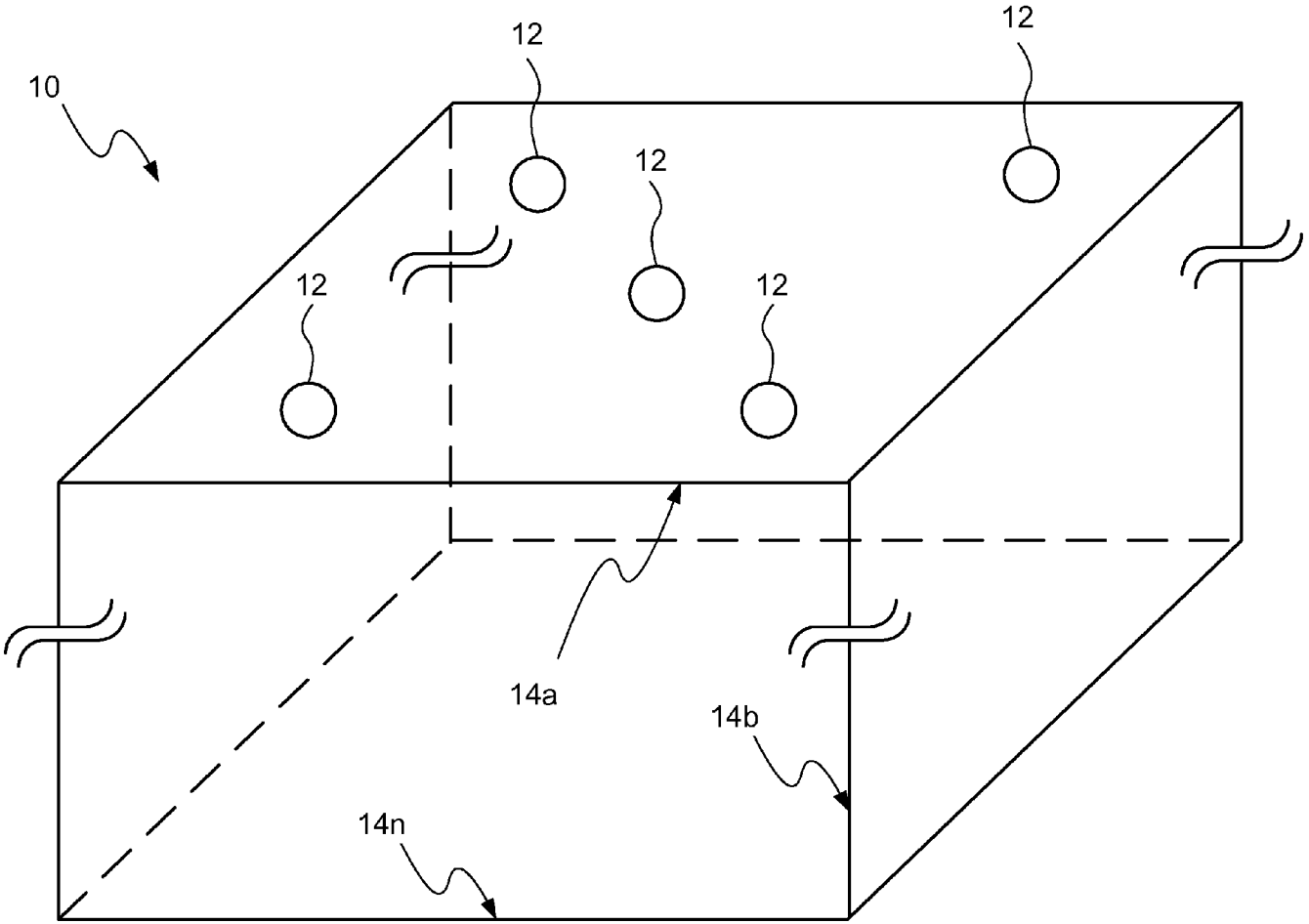
FIG. 1 is a block diagram of one exemplary embodiment of a system consistent with the present disclosure.

Turning now to FIG. 1, one embodiment illustrating a lighting system 10 consistent with the present disclosure is generally illustrated. The lighting system 10 includes at least one partially-recessed luminaire 12 coupled, mounted, fixed, or otherwise secured to at least one mounting substrate 14*a-n*. For the sake of brevity, the partially-recessed luminaire 12 (also referred to simply as "luminaire") will be described as a being coupled to a ceiling 14*a*; however, it will be appreciated that the luminaire 12 may also be coupled to any mounting substrate 14*a-n* such as, but not limited to, a wall 14*b*, floor 14*n*, roof, or the like.

Figure 2:
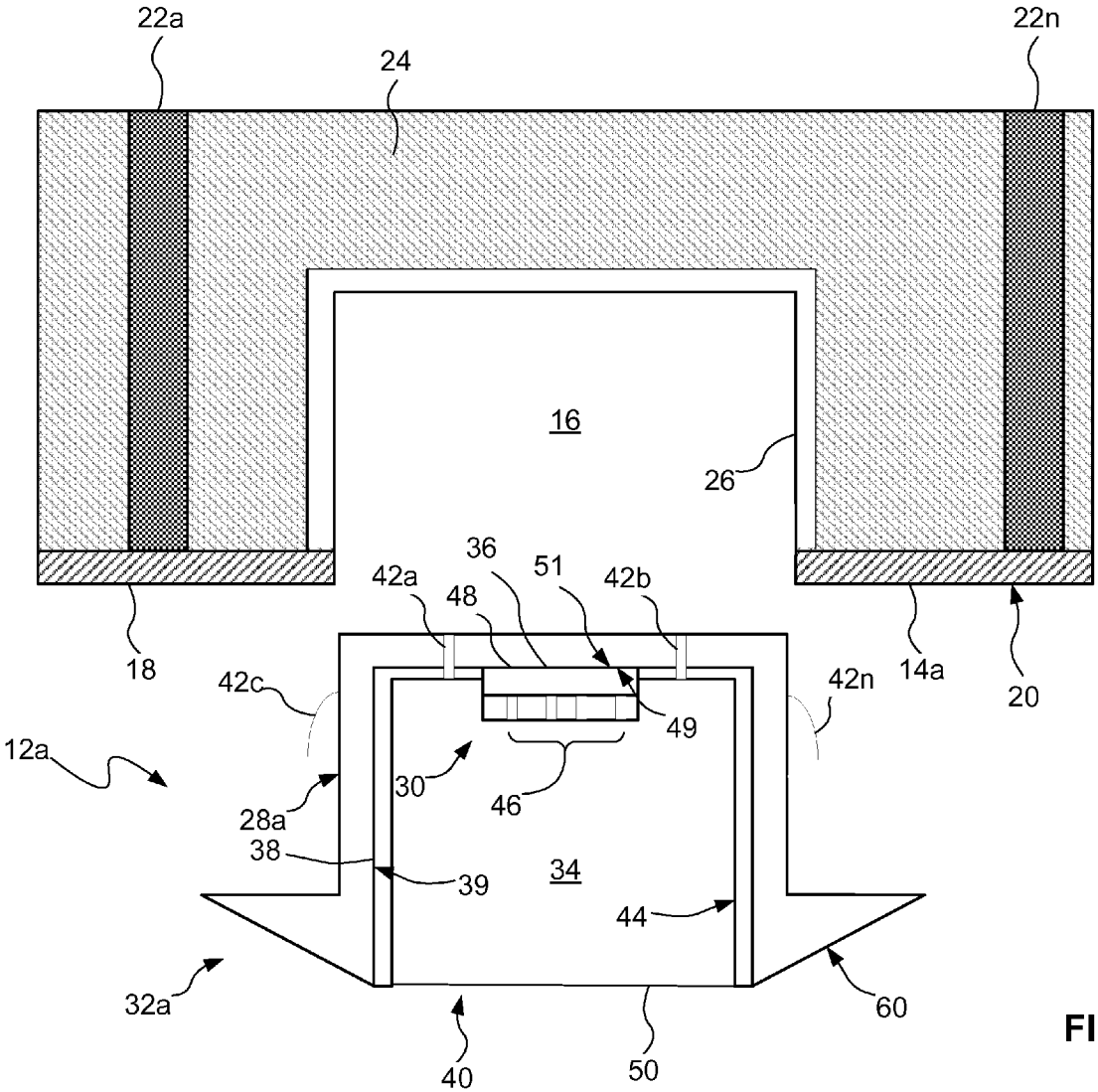
FIG. 2 is a cross-sectional view of one embodiment of a luminaire consistent with the present disclosure.
Figure 3:
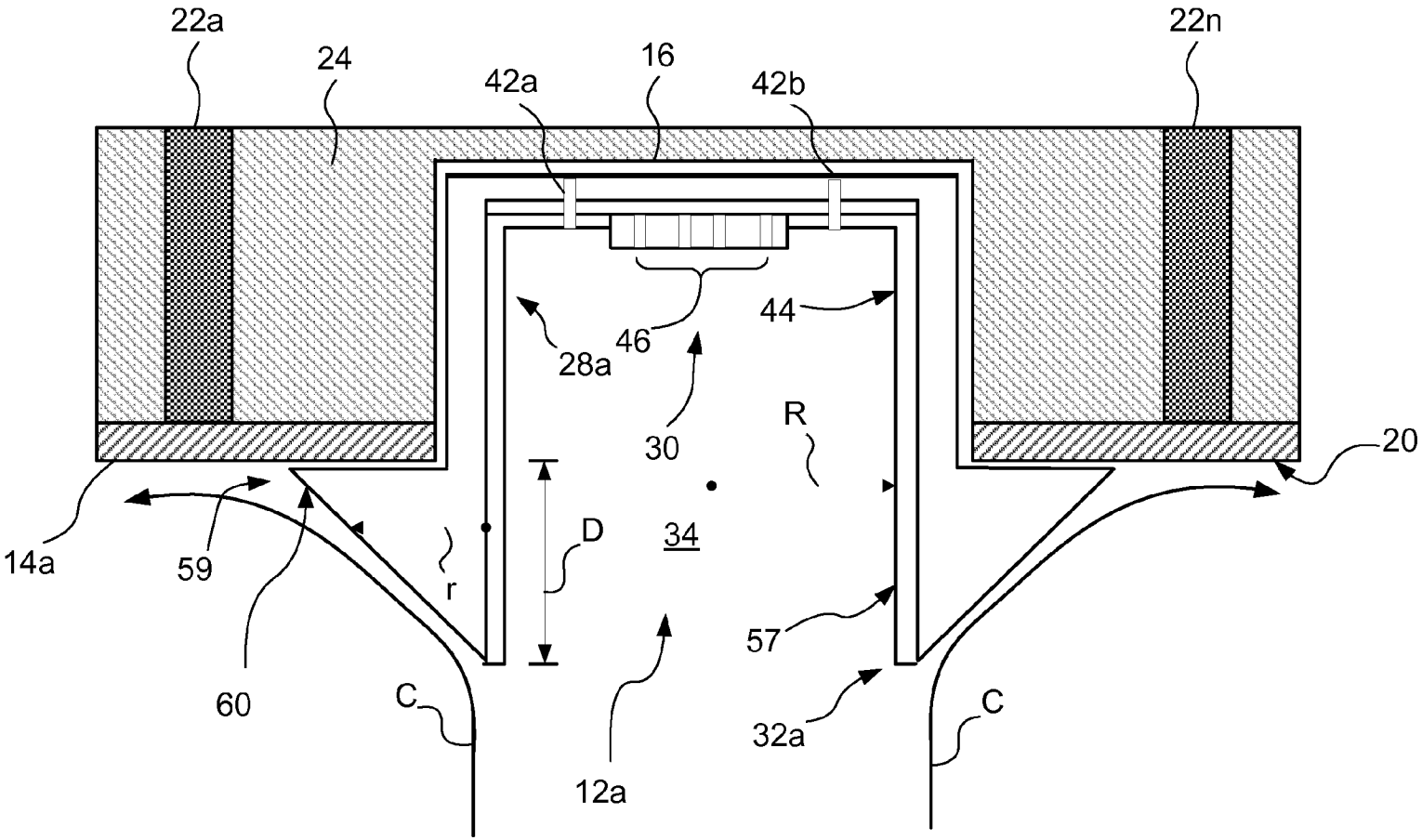
FIG. 3 is a cross-sectional view of the luminaire of FIG. 2 received within a recess of a support surface consistent with the present disclosure.

Referring now to FIGS. 2 and 3, a cross-sectional view of one embodiment of a luminaire 12*a* for use with a ceiling 14*a* is generally illustrated. The luminaire 12*a* may be configured to be at least partially received in a recess 16 formed within the ceiling 14*a*, for example, as generally illustrated in FIG. 3. The ceiling 14*a* may include an exterior layer 18 (for example, but not limited to, sheet rock, wood, a dropped ceiling, or the like) having a bottom surface 20, at least one stud or support 22*a-n*, and optionally insulation 24 (such as, but not limited to, thermal and/or sound insulation). As used herein, the exterior layer 18 and bottom surface thereof are intended to refer to the layer and surface of the ceiling 14*a* which are exposed to the area illuminated by the luminaire 12. Optionally, the recess 16 may include an electrical box 26 depending on the building codes. For example, the electrical box 26 may include any electrical box compatible with UL® or the like. One or more electrical wires (not shown for clarity) may be provided to supply AC and/or DC current to the luminaire 12. The recess 16 and/or electrical box 26 may have any shape such as, but not limited to, a generally square, generally rectangular, or generally circular shape.

The luminaire 12*a* includes a fixture 28*a*, a light engine 30 configured to be coupled to the fixture 28*a*, and a heat flange 32*a* configured to extend outwardly beyond the bottom surface 20 of the ceiling 14*a* when the luminaire is fully received in the recess as shown in FIG. 3. The fixture 28*a* may define a cavity 34 having a base 36, at least one sidewall 38, and an open end 40. The fixture 28*a* may be made from a material with a high thermal conductivity such as, but not limited to, a material having a thermal conductivity of 100 W/(m*K) or greater, for example, 200 W/(m*K) or greater. According to one embodiment, the fixture 28*a* may include a metal or metal alloys (such as, but not limited to, aluminum, copper, silver, gold, or the like), plastics (e.g., but not limited to, doped plastics), as well as composites. The size, shape and/or configuration (e.g., surface area) of the fixture 28*a* may depend upon a number of variables including, but not limited to, the maximum power rating of the light engine 30, the size/shape of the recess 16 and/or electrical box 26, and the like.

The fixture 28*a* may include one or more mounting devices 42*a-n* for securing the luminaire 12*a* to the recess 16 and/or electrical box 26. The mounting devices 42*a-n* may include one or more openings or passages 42*a*, b extending through the fixture 28*a* for receiving a fastener (such as, but not limited to, a screw, bolt, or the like, not shown for clarity) which may engage a corresponding feature of the recess 16 and/or electrical box 26 (also not shown for clarity). Alternatively (or in addition), the mounting device 42*a-n* may include one or more biasing devices (such as, but not limited to, biased tabs, springs, or the like 42*c*) configured to engage a portion of the sidewalls of the recess 16 and/or electrical box 26.

Optionally, the fixture 28*a* may include one or more surface layers 44 covering at least a portion of the internal surface of at least one of the base 36 and sidewall 38. The surface layers 44 may include an optical coating configured to reflect and/or direct light generated from the light engine 30 out the open end 40. For example, the optical coating may include a reflector and/or a lens configured to direct and/or focus light emitted from the light engine 30 out of the open end 40 of the luminaire 12*a*. Alternatively (or in addition), the surface layers 44 may include a thermal layer configured to increase the amount of thermal energy transferred from the light engine to the heat flange 32*a*. For example, the thermal layer may also have a high thermal conductivity, k, (e.g., but not limited to, a thermal conductivity, k, of 1.0 W/(m*K) or greater) to transfer thermal energy from the light engine 30 into the fixture 28*a* and to the heat flange 32*a*, thereby reducing the junction temperature of the light engine 30. The fixture 28*a* may also optionally include a lens and/or diffuser 50 extending across the open end 40 configured to diffuse the light emitted from the light engine 30.

The light engine 30 may include any light source including, but not limited to, gas discharge light sources (such as, but not limited to, high intensity discharge lamps, fluorescent lamps, low pressure sodium lamps, metal halide lamps, high pressure sodium lamps, high pressure mercury-vapor lamps, neon lamps, and/or xenon flash lamps) as well as one or more solid-state light sources (e.g., but not limited to, semiconductor light-emitting diodes (LEDs), organic light-emitting diodes (OLED), or polymer light-emitting diodes (PLED), hereinafter collectively referred to as "LEDs 46"). The number, color, and/or arrangement of LEDs 46 may depend upon the intended application/performance of the luminaire 12*a*. The LEDs 46 may be coupled and/or mounted to a substrate (e.g., but not limited to, a ballast, PCB or the like 48). The PCB 48 may comprise additional circuitry (not shown for clarity) including, but not limited to, resistors, capacitors, etc., which may be operatively coupled to the PCB 48 configured to drive or control (e.g., power) the LEDs 46. According to one embodiment, the PCB 48 may be directly coupled to the fixture 28*a*. For example, a first surface 49 of the PCB 48 may contact or abut against a surface 51 of the fixture 28*a* to conduct thermal energy away from the LEDs 46.

Optionally, the light engine 30 also includes one or more thermal interface materials (e.g., gap pads, not shown for clarity) disposed between the PCB 48 and the fixture to decrease the contact thermal resistance between the PCB 48 (and LEDs 46) and the fixture 28*a*. The thermal interface material may include outer surfaces which directly contact (e.g., abut against) surfaces 49, 51 of the PCB 48 and the fixture 28*a*, respectively. The thermal interface material may include a material having a higher thermal conductivity, k, configured to reduce the thermal resistance between the PCB 48 and the fixture 28*a*. For example, the thermal interface material may have a thermal conductivity, k, of 1.0 W/(m*K) or greater, 1.3 W/(m*K) or greater, 2.5 W/(m*K) or greater, 5.0 W/(m*K) or greater, 1.3-5.0 W/(m*K), 2.5-5.0 W/(m*K), or any value or range therein. The thermal interface material may include a deformable (e.g., a resiliently deformable) material configured to reduce and/or eliminate air pockets between the outer surfaces 49, 51 of the PCB 48 and the fixture 28*a* to reduce contact resistance. The thermal interface material may have a high conformability to reduce interface resistance The interface material may have a thickness of from 0.010" to 0.250" when uncompressed. Optionally, one or more outer surfaces of the first thermal interface material may include an adhesive layer configured to secure the thermal interface material to the PCB 48 or the fixture 28*a*, respectively. The adhesive may be selected to facilitate thermal energy transfer (e.g., the adhesive may have a thermal conductivity k of 1 W/(m*K) or greater. Additionally (or alternatively), the PCB 48 and the fixture 28*a* may be coupled (e.g., secured) together using one or more fasteners such as, but not limited to, screws, rivets, bolts, clamps, or the like. The thermal interface material may also be electrically non-conductive (i.e., an electrical insulator) and may include a dielectric material.

As discussed above, the luminaire 12*a* also includes a heat flange 32*a* coupled to the fixture 28*a*. The heat flange 32*a* may be made from a material having a high thermal conductivity (such as, but not limited to, a material having a thermal conductivity of 100 W/(m*K) or greater, for example, 200 W/(m*K) or greater) configured to transfer thermal energy away from the fixture 28*a*, thereby reducing the junction temperature of the LEDs 46 that make up the light engine 30. According to one embodiment, the fixture 28*a* may include a metal or metal alloys (such as, but not limited to, aluminum, copper, silver, gold, or the like), plastics (e.g., but not limited to, doped plastics), as well as composites. The heat flange 32*a* may be the same as the fixture 28*a* or a different material than the fixture 28*a*.

The heat flange 32*a* may include a hollow, generally conical frustum shape having a generally circular cross-section which generally linearly tapers radially outwardly from the distal-most end 57 towards the fixture 28*a*. Stated another way, the half-width r of the conical heat flange 32*a* (i.e., the flange half-width r) increases from the distal-most end 57 to proximal-most end 59 of the heat flange 32*a*. As used herein, the term "generally conical frustum" is intended to mean that the top and base of the cone may be, but do not necessarily have to be, parallel to each other.

The distal-most end 57 of the heat flange 32*a* also extends downwardly a depth D beyond the bottom surface 20 of the ceiling 14*a*. The depth D of the heat flange 32*a* may be selected such that the heat flange 32*a* has a surface area large enough to transfer enough thermal energy from the heat flange 32 to the surrounding air by thermal convection to create an air current (as represented by arrows C) across the tapered exterior surface 60 of the heat flange 32*a*. The shape of the heat flange 32*a* also generates air currents C that flow upwardly across the heat flange 32*a* and radially outwardly generally parallel to the bottom surface 20 of the ceiling 14*a*. Because the heated air currents C flow generally along the bottom surface 20 of the ceiling 14*a*, a larger area of the ceiling 14*a* is exposed to the heated air currents C, thereby reducing the temperature differential needed to transfer thermal energy from the heated air currents C to the ceiling 14*a*. The net result is that more thermal energy is transferred from the light engine 30 to the air, and ultimately to the ceiling 14*a*, thereby reducing the junction temperature of the light engine 30.

According to one embodiment, the heat flange 32*a* has a depth D equal to or greater than 0.4 times the radius R of the fixture 28*a* (i.e., equal to or greater than 0.2 times the diameter of the fixture 28*a*). For example, the depth D may be equal to or greater than 0.6 times the radius R of the fixture 28*a* (i.e., equal to or greater than 0.3 times the diameter of the fixture 28*a*); equal to or greater than 0.8 times the radius R of the fixture 28*a* (i.e., equal to or greater than 0.4 times the diameter of the fixture 28*a*); and/or equal to or greater than 1.2 times the radius R of the fixture 28*a* (i.e., equal to or greater than 0.6 times the diameter of the fixture 28*a*). Alternatively, the depth D of the heat flange 32*a* may be selected to be greater than or equal to 0.4R and less than or equal to 2R; greater than or equal to 0.4R and less than or equal to 1.4R; greater than or equal to 0.8R and less than or equal to 1.6R; greater than or equal to 0.8R and less than or equal to 1.4R, and/or any value in between. It should be understood that all luminaires consistent with FIGS. 1-15 and the present disclosure feature heat flanges having the above described relationships between the distance D and radius R.

The conical heat flange 32*a* may have a maximum flange half-width r (e.g., at the proximal-most end 59 of the heat flange 32*a* configured to be adjacent to the ceiling 14*a*) equal to or greater than 0.4 times the radius R of the fixture 28*a*. For example, the conical heat flange 32*a* may have a maximum flange half-width r equal to or greater than the radius R of the fixture 28*a*. It should be understood that all luminaires consistent with FIGS. 1-15 and the present disclosure feature heat flanges having the above described relationships between the maximum flange half-width r and radius R.

Figure 4:
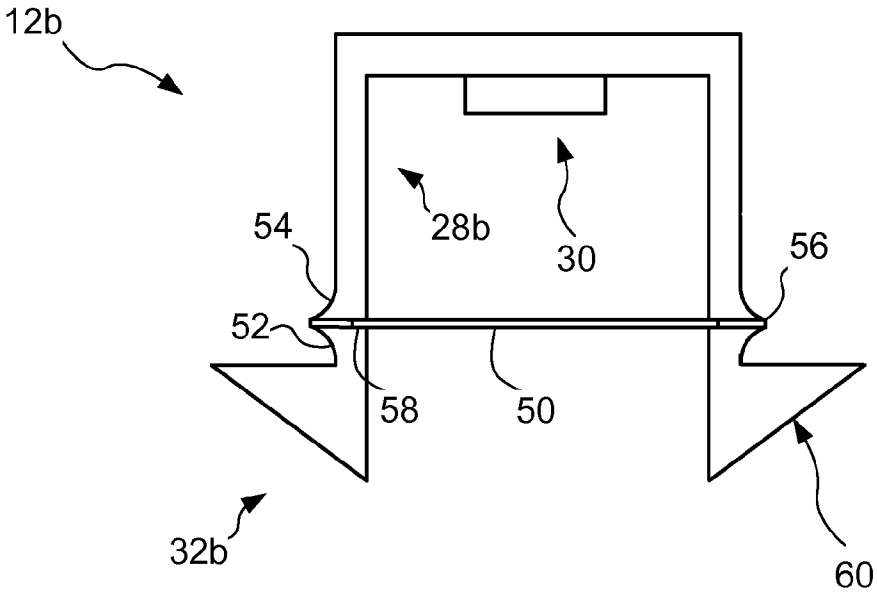
FIG. 4 is a cross-sectional view of another embodiment of a luminaire consistent with the present disclosure.

Turning now to FIG. 4, the luminaire 12*b* may include a fixture 28*b*, a light engine 30, and a heat flange 32 coupled to the fixture 28*b*, for example, using an adhesive, friction connection, and/or one or more fasteners (not shown for clarity). The heat flange 32*b* includes the same material as the fixture 28*b* or a different material than the fixture 28*b*. Optionally, the luminaire 12*b* may include one or more thermal interface materials 56 (e.g., gap pads) disposed between the fixture 28*b* and the heat flange 32*b* to further increase the rate of thermal energy transferred from the fixture 28*b* to the heat flange 32*b* (and ultimately away from the LEDs 46 and the PCB 48, not shown in FIG. 4 for clarity). For example, the thermal interface material 56 may include outer surfaces which at least partially contact (e.g., abut against) at least a portion of the surfaces of the heat flange 32*b* and/or the fixture 28*b*. According to one embodiment, the thermal interface material 56 may be disposed between (and optionally abut against) one or more of the flanges 52, 54 of the heat flange 32*b* and the fixture 28*b*, respectively.

The thermal interface material 56 may include a material having a reasonably high thermal conductivity, k, configured to reduce the thermal resistance between the heat flange 32*b* and the fixture 28*b*. For example, the thermal interface material 56 may have a thermal conductivity k of 1.0 W/(m*K) or greater, 1.3 W/(m*K) or greater, 2.5 W/(m*K) or greater, 5.0 W/(m*K) or greater, 1.3-5.0 W/(m*K), 2.5-5.0 W/(m*K), or any value or range therein. The thermal interface material 56 may include a deformable (e.g., a resiliently deformable) material configured to reduce and/or eliminate air pockets between the surfaces of the heat flange 32*b* and the fixture 28*b* to reduce contact resistance. The thermal interface material 56 may have a high conformability to reduce interfacial resistance.

The thermal interface material 56 may have a thickness of from 0.010" to 0.250" when uncompressed. Optionally, one or more outer surfaces of the thermal interface material 56 may include an adhesive layer (not shown for clarity) configured to secure the thermal interface material 56 to the fixture 28*b* or the heat flange 32*b*. Additionally (or alternatively), the fixture 28*b* and the heat flange 32*b* may be secured together using one or more fasteners (not shown for clarity) such as, but not limited to, screws, rivets, bolts, clamps, or the like. The interface material 56 may also be electrically non-conductive (i.e., an electrical insulator), and may include a dielectric material.

The heat flange 32*b* and the fixture 28*b*, when secured together, may optionally define a lens cavity 58 configured to receive at least a portion of the outer periphery of a lens/diffuser 50 such that the lens/diffuser 50 is sandwiched between the fixture 28*b* and the heat flange 32*b*. Of course, the lens/diffuser 50 may be secured between and/or to the fixture 28*b* and/or heat flange 32*b* in a variety of different manners. For example, while not an exhaustive list, the lens/diffuser 50 may be an integral component with the surface layer 44 and/or may be secured to the fixture 28*b* and/or heat flange 32*b* using a fastener, adhesive, welding (e.g., but not limited to, ultrasonic welding), or the like (not shown for clarity).

Figure 5:
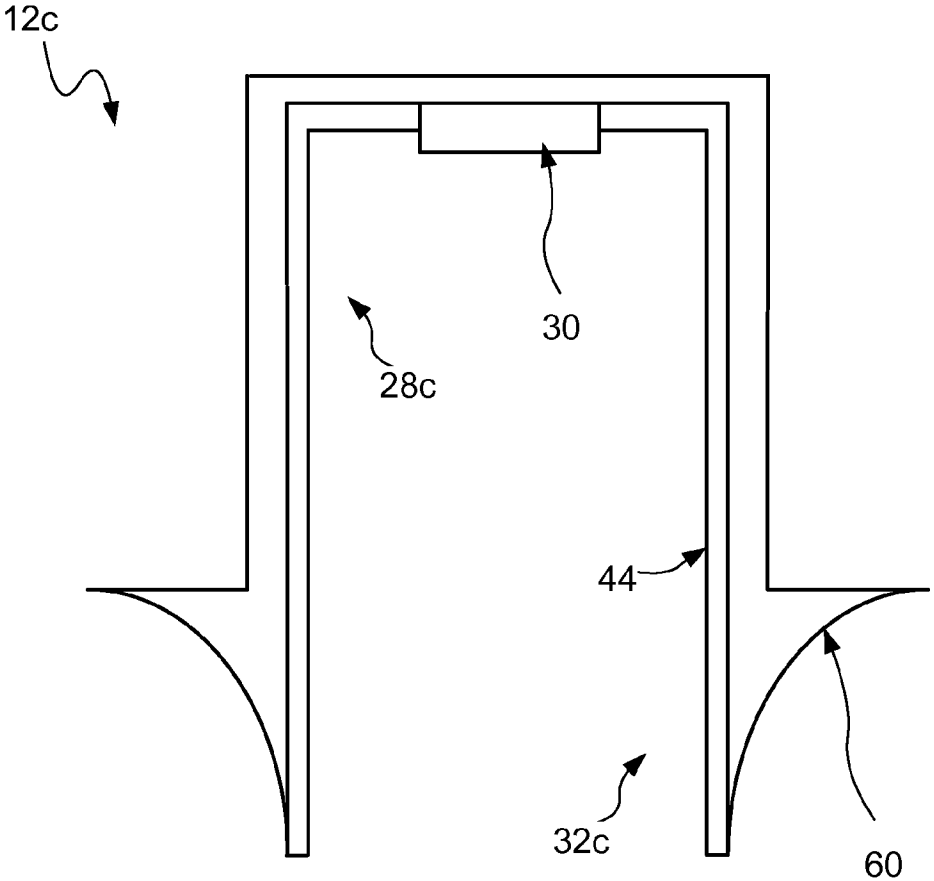
FIG. 5 is a cross-sectional view of yet another embodiment of a luminaire consistent with the present disclosure.

Turning now to FIG. 5, a cross-sectional view of another embodiment of a luminaire 12*c* is generally illustrated. The luminaire 12*c* includes a fixture 28*c*, a light engine 30, and a heat flange 32*c* having a hollow, generally conical frustum shape having a generally circular cross-section which curves or flares radially outwardly from the distal-most end 57 towards the fixture 28*c*. The curved heat flange 32*c* may increase the area of the surface 60 of the heat flange 32*c* which is exposed to the surrounding air, thereby enhancing the air currents generated. As a result, more thermal energy may be transferred from the curved heat flange 32*c* compared to the straight heat flange 32*a* (e.g., as illustrated in FIGS. 2 and 3) and the junction temperature of the light engine 30 may be further reduced.

Figure 6:
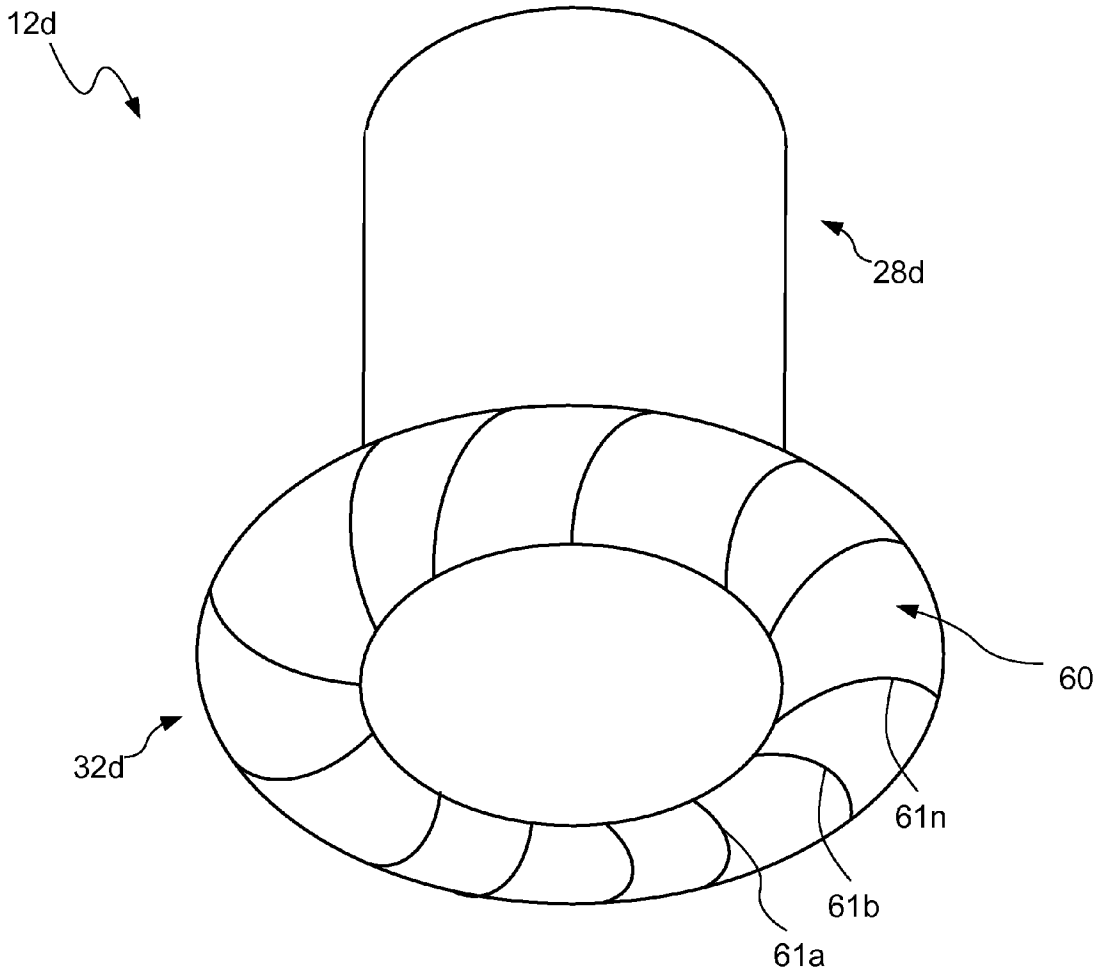
FIG. 6 is a cross-sectional view of a further embodiment of a luminaire consistent with the present disclosure.

Referring now to FIG. 6, an end perspective view of yet another embodiment of a luminaire 12*d* is generally illustrated. The luminaire 12*d* includes a fixture 28*d*, a light engine 30 (not shown because of the view), and a heat flange 32*d* having one or more (e.g., a plurality) of fins 61*a-n* extending generally outwardly from the heat flange 32*d*. For example, the fins 61*a-n* may extend along a longitudinal axis of the luminaire 12*d*; however, the fins 61*a-n* may extend diagonally and/or perpendicular to the longitudinal axis of the luminaire 12*d*. The fins 61*a-n* may further increase the area of the surface 60 of the heat flange 32*d* which is exposed to the surrounding air, thereby transferring more thermal energy from the heat flange 32*d* compared to the straight heat flange 32*a* and further reducing the junction temperature of the light engine 30. The heat flange 32*d* may have a generally straight cross-section (e.g., as generally illustrated in FIG. 2) and/or a curved cross-section (e.g., as generally illustrated in FIG. 5). The fins 61*a-n* may extend generally outwardly at a constant distance from the heat flange 32*d* and/or may have a tapered shape. The fins 61*a-n* may be evenly and/or unevenly spaced along the heat flange 32*d*. In addition, the fins 61*a-n* may have a generally pin-like or generally cylindrical shape.

Figure 7:
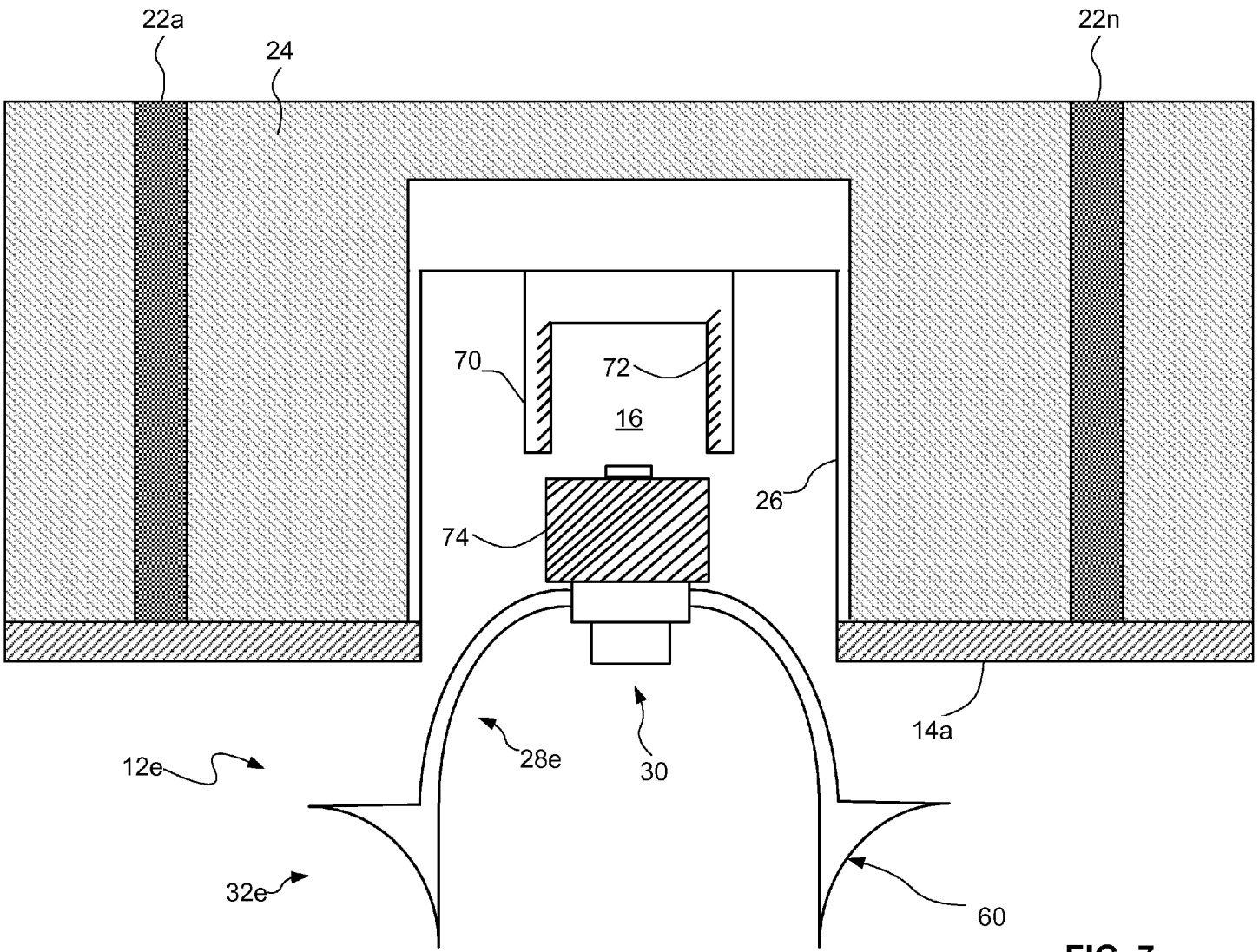
FIG. 7 is a cross-sectional view of another embodiment of a retrofit luminaire consistent with the present disclosure.

Yet another embodiment of a luminaire 12*e* consistent with the present disclosure is generally illustrated in FIG. 7. In particular, the luminaire 12*e* may be configured to be retrofitted to an existing light socket 70. The light socket 70 may include an Edison screw-type light socket having a threaded socket 72 configured to receive a corresponding threaded portion 74 of the luminaire 12*e*. For example, the light socket 70 may include, but is not limited to, an E12, E11, E17, E14, E26, E27, E39, or and E40. The luminaire 12*e* may also include a fixture 28*e*, a light engine 30, and a heat flange 32*e*. The heat flange 32*e* may include any heat flange consistent with the present disclosure.

Figure 8:
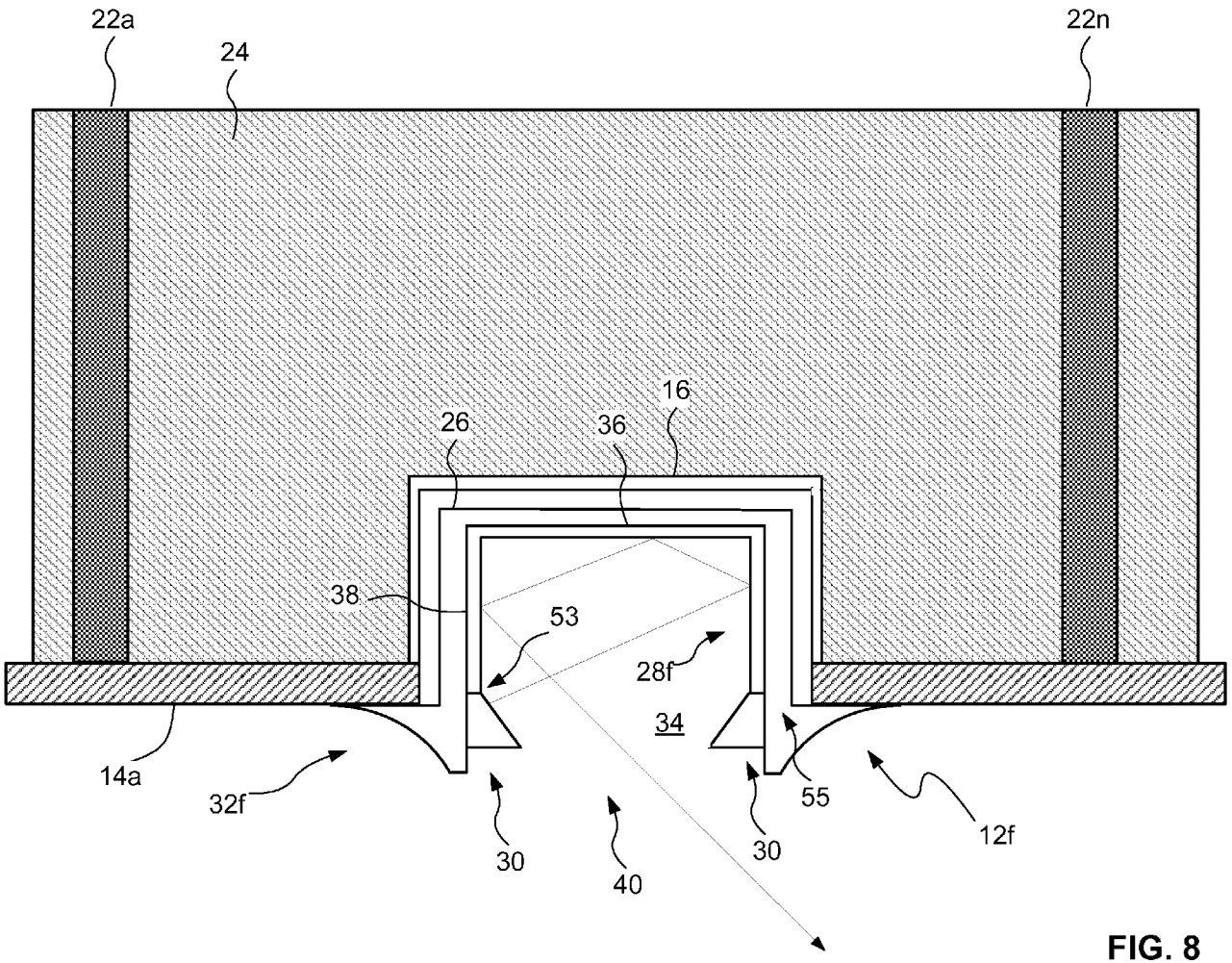
FIG. 8 is a cross-sectional view of another embodiment of a luminaire consistent with the present disclosure.

Turning now to FIG. 8, a cross-sectional view of yet a further embodiment of a luminaire 12*f* consistent with the present disclosure is generally illustrated. The luminaire 12*f* includes a fixture 28*f*, one or more light engines 30*f*, and a heat flange 32. The heat flange 32*f* may include any heat flange consistent with the present disclosure. Rather than having the light engine 30 disposed at the base 36 of the fixture 28*f*, one or more light engines 30 may be coupled to the sidewalls 38 of the fixture 28*f* and/or the heat flange 32*f*. For example, the light engines 30 may be disposed proximate to the distal end 53 of the fixture 28*f* and/or the proximal end 55 of the heat flange 32*f*. The light engine 30 may be configured to emit light directly out the open end 40 of the luminaire 12*f* and/or emit light into the cavity 34 where it is reflect out the open end 40. Placing the light engine 30 on the sidewalls 38 and/or the heat flange 32*f* may increase the amount of thermal energy which is transferred from the light engine 30 to the heat flange 32*f* and ultimately to the surrounding air, thereby reducing the junction temperature of the light engine 30. While not shown, the luminaire 12*f* may also include one or more light engines coupled to the base 36 of the fixture 12*f*.

Figure 9A:
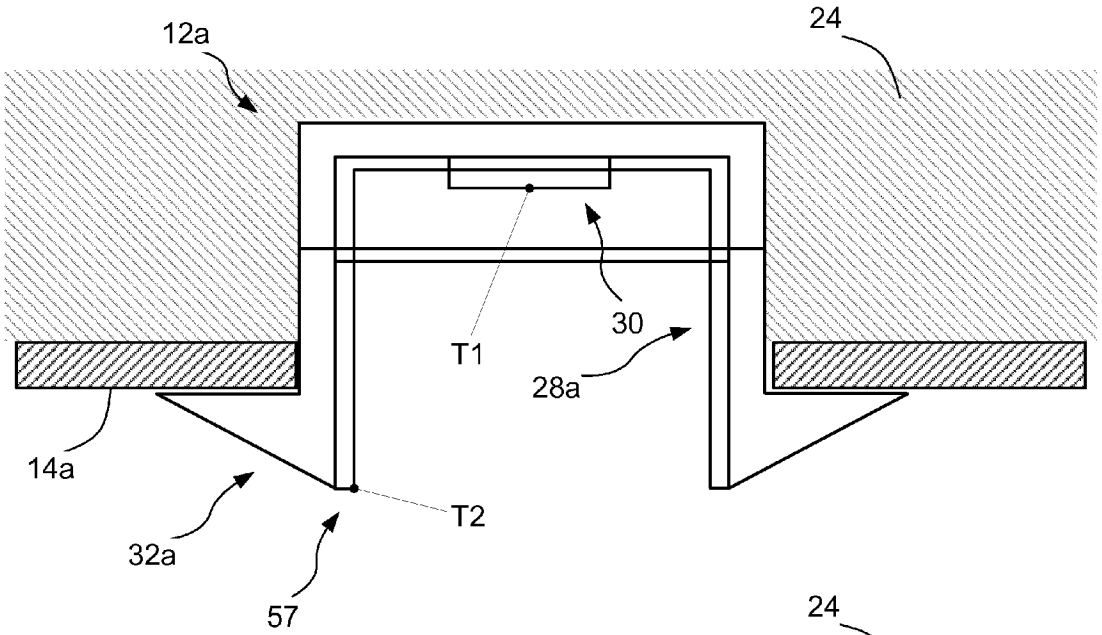
FIGS. 9A and 9B are cross-sectional views illustrating the placement of thermocouples T1 and T2.
Figure 9B:
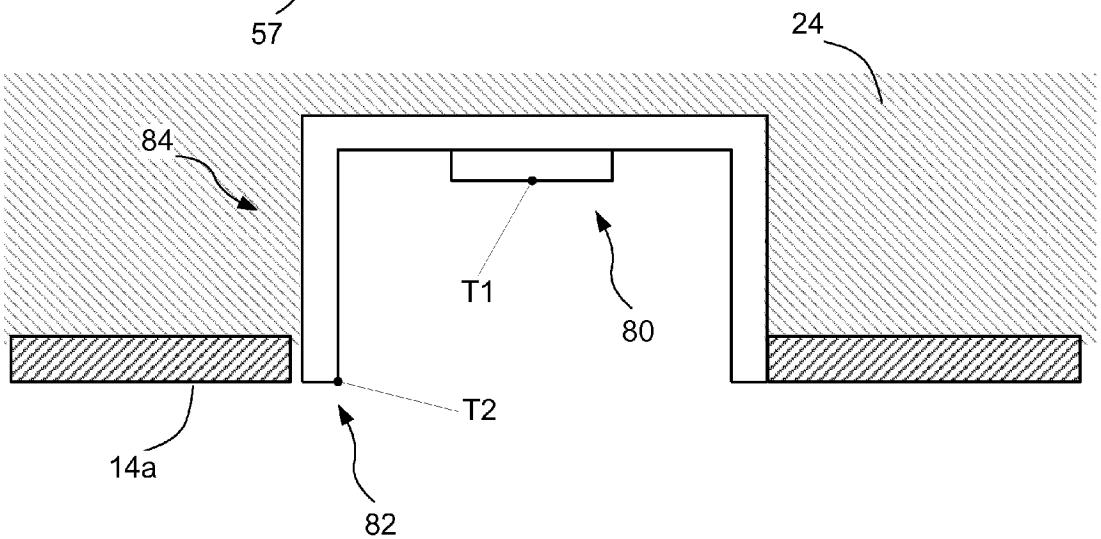

Experiments were performed on a luminaire 12*a* consistent with FIG. 3 as well as a flush-mounted luminaire. In particular, as generally illustrated in FIG. 9A, a first and a second thermocouple T1, T2 were placed on the light engine 30 (which was replace by a heater) and the proximal-most end 57 of a luminaire 12*a* consistent with FIG. 3. Similarly, a first and a second thermocouple T1, T2 were placed on the light engine 80 (which was replace by a heater) and the proximal-most end 82 of a flush-mounted luminaire 84 as generally illustrated in FIG. 9B. The light engines 30, 80 in both the luminaires 12*a*, 84 of FIGS. 9A and 9B generated 23 watts of thermal energy. While note shown, the luminaires 12*a*, 84 were also surrounded by insulation 24 to simulate a typical installation in a ceiling 14*a*. The temperature of the thermocouples T1 and T2 for each luminaire 12*a*, 84 was then recorded as a function of time as generally illustrated in FIGS. 10 and 11.

Figure 10:
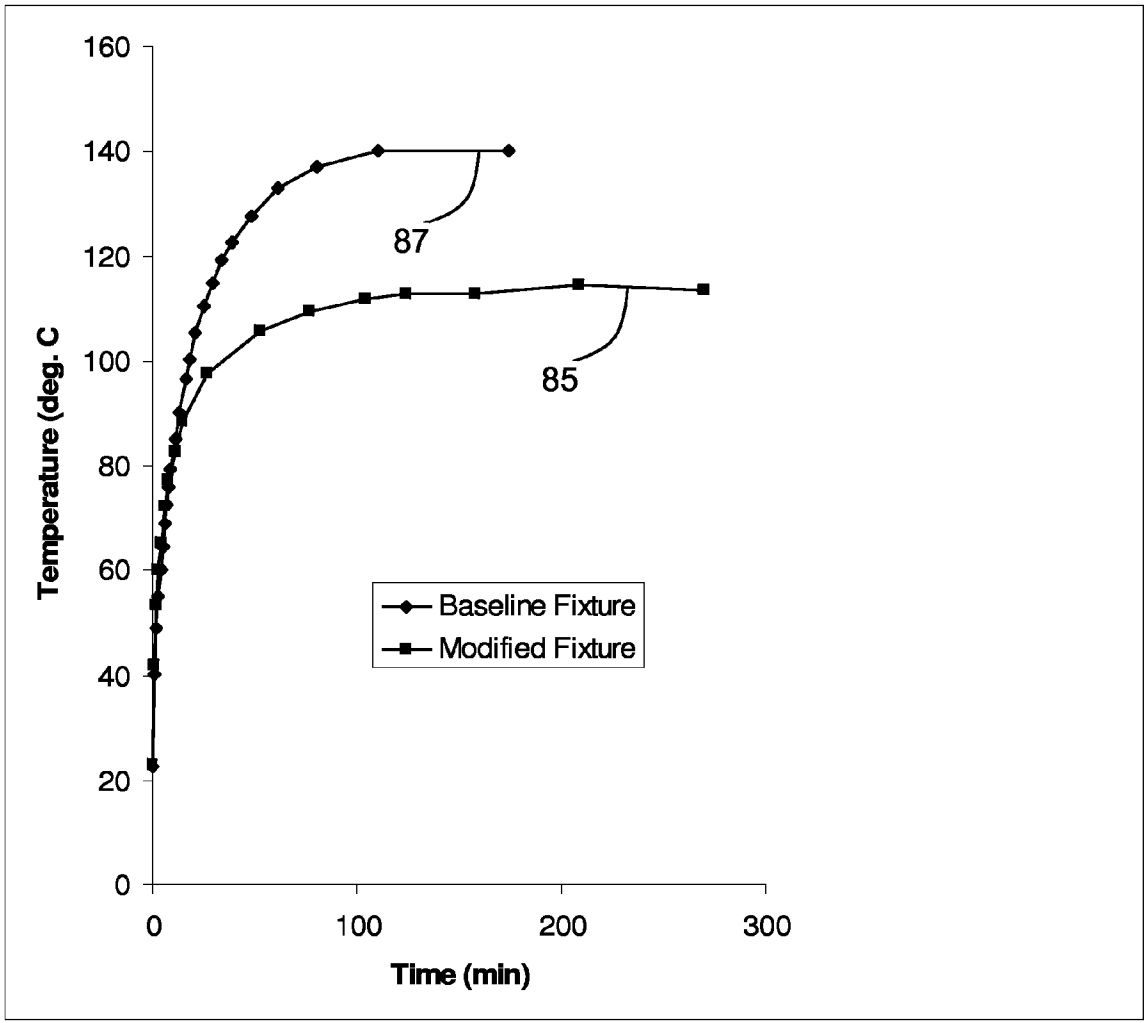
FIG. 10 depicts a comparison of the temperatures of the thermocouples T1 in a partially-recessed luminaire consistent with the present disclosure and a flush-mounted luminaire.

In particular, FIG. 10 generally illustrates the temperature 85, 87 of the first thermocouple T1 in each luminaire 12, 84, respectively. As may be seen, the flush-mounted luminaire 84 of FIG. 9B had a steady state temperature 87 of approximately 140 degrees C. after approximately 3-5 hours (steady state was assumed at the point when the temperature of the thermocouple T1 stopped rising). In contrast, the luminaire 12*a* of FIG. 9A had a steady state temperature 85 of approximately 115 degrees C. (a reduction of approximately 25 degrees C.).

Figure 11:
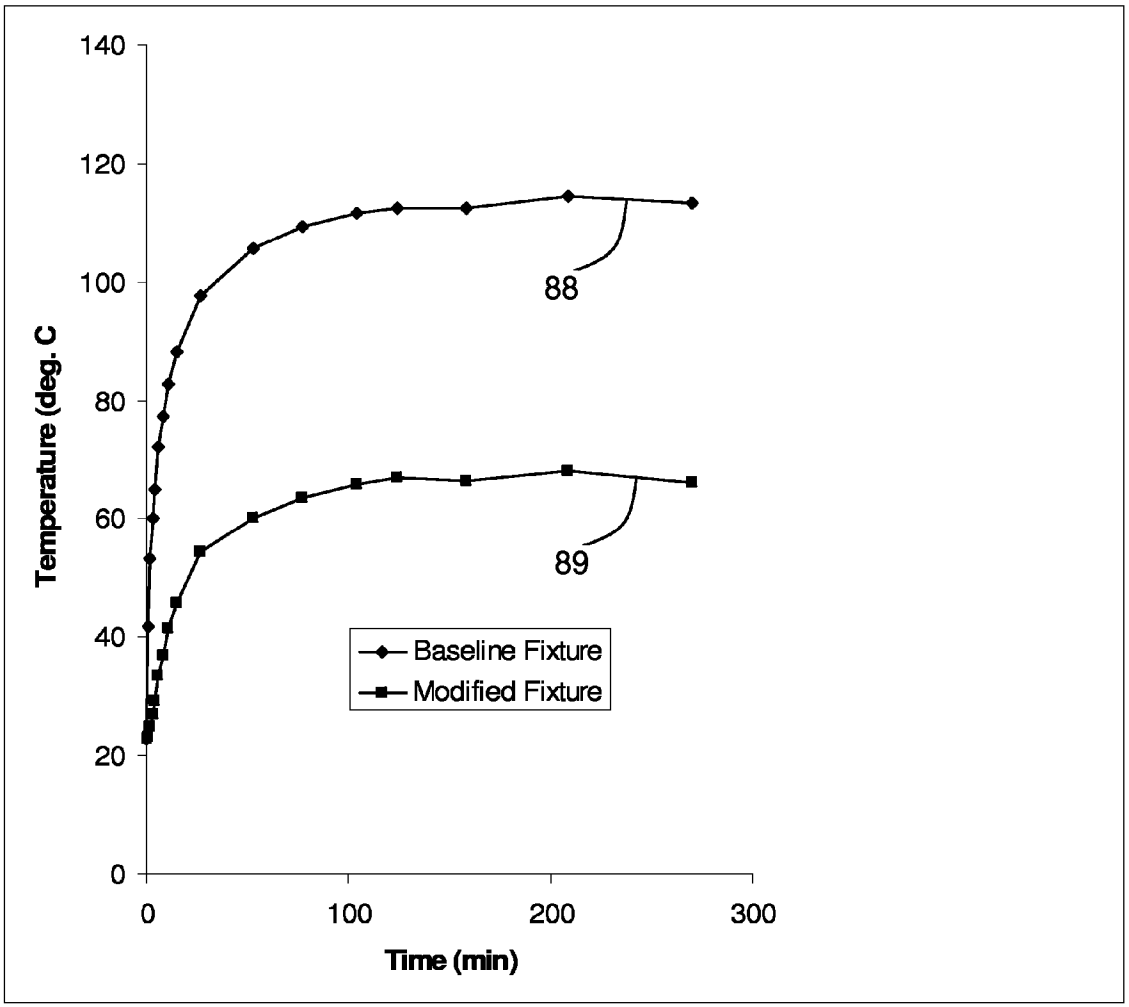
FIG. 11 depicts a comparison of the temperatures of the thermocouples T2 in a partially-recessed luminaire consistent with the present disclosure and a flush-mounted luminaire.

Turning now to FIG. 11, the temperature 88, 89 of the second thermocouple T2 in each luminaire 12*a*, 84, respectively, is generally illustrated. As may be seen, the difference in the temperature 88, 89 at T2 between the luminaires 12*a*, 84 is even larger at the bottom 57, 82 of the luminaires 12*a*, 84 than it is at the light engine 30, 80. While this result may at first seem counterintuitive, the reason is that much more thermal energy is removed from the partially-recessed luminaire 12*a* at the bottom (due to convection) than is removed from the flush-mounted luminaire 84. The additional flow of thermal energy of the partially-recessed luminaire 12*a* imposes an additional temperature difference top-to-bottom in the partially-recessed luminaire 12*a*. As a result, the partially-recessed luminaire 12*a* runs approximately 40 degrees cooler at the bottom 57 compared to the bottom 82 of the flush-mounted luminaire 84.

Figure 12:
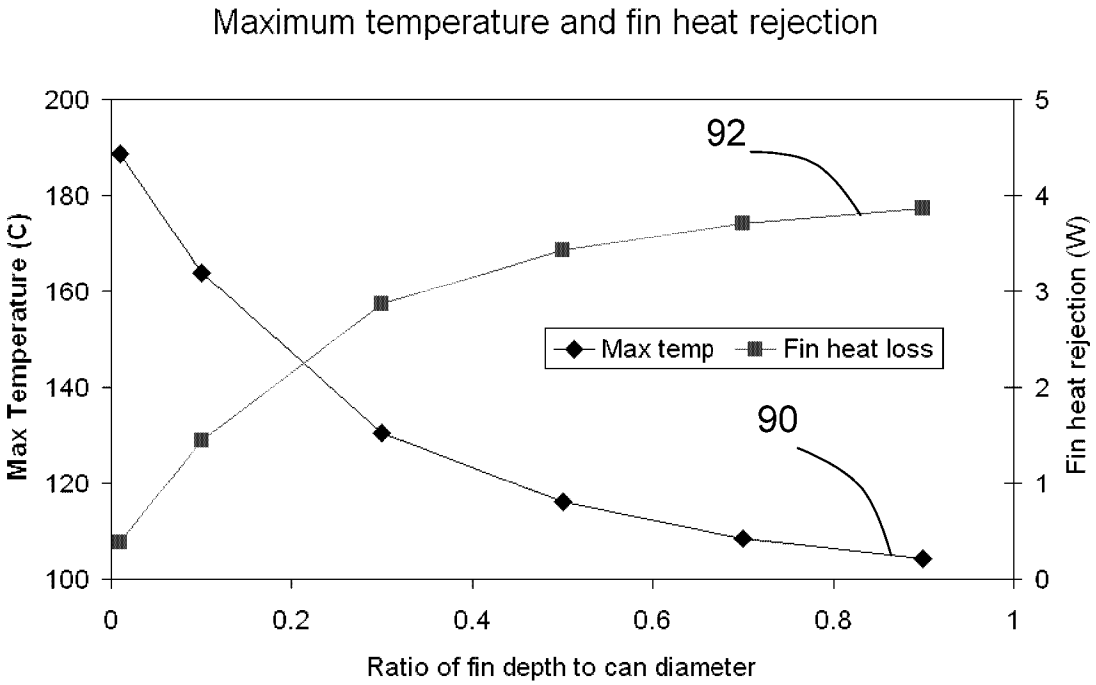
FIG. 12 depicts the maximum temperature and heat rejection as function of the ratio of the heat flange depth to the cavity is varied.
Figure 13:
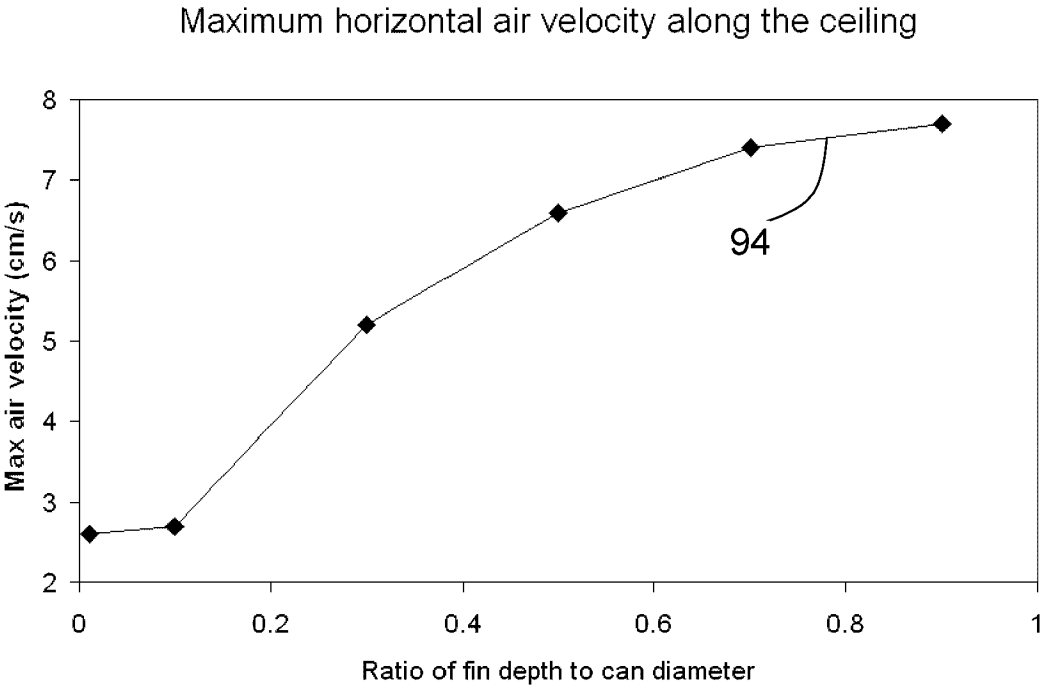
FIG. 13 depicts the maximum horizontal air velocity as the ratio of depth of the heat flange to the cavity is varied.

Turning now to FIGS. 12 and 13, simulations were performed on a variety of luminaires having a flared heat flange (for example, a heat flange as generally illustrated in FIG. 5) with different depths D. In particular, FIG. 12 generally illustrates the maximum temperature 90 of the light engine as a function of the normalized depth D of the heat flange. In addition, the maximum temperature 92 of the proximal-most end of the heat flange (i.e., the amount of thermal energy rejected from the heat flange to the air) was also recorded as a function of the normalized depth D of the heat flange. FIG. 13 generally illustrates maximum horizontal air velocity 94 along the ceiling as a function of the normalized depth D of the heat flange. As can be seen, the maximum horizontal air velocity 94 (FIG. 13) increases significantly after the normalized depth D of the heat flange exceeds a ratio of approximately 0.2 (i.e., 0.4R). The increased thermal energy rejection 92 and corresponding lower temperature 90 of FIG. 12 is due to the combined effects of the higher air velocity 94 of FIG. 13 and the larger exposed surface area of the heat flange.

Figure 14:
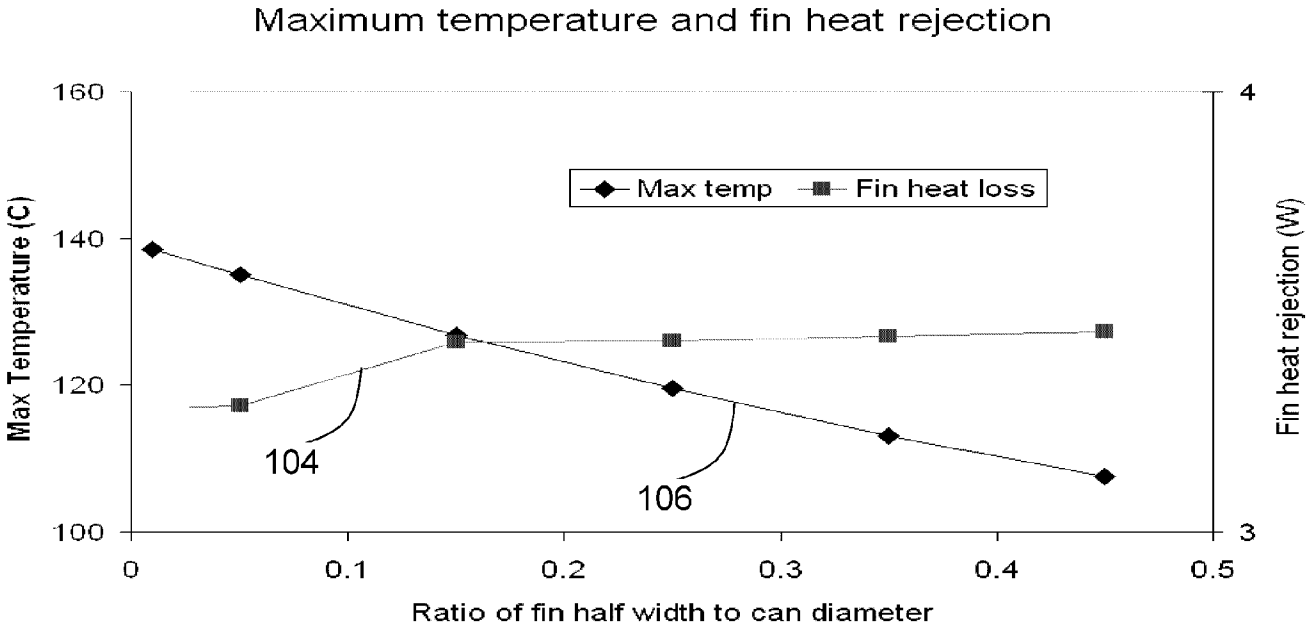
FIG. 14 depicts the maximum temperature and heat rejection as a function of the ratio of the flange half-width r to normalized diameter of luminaire.
Figure 15:
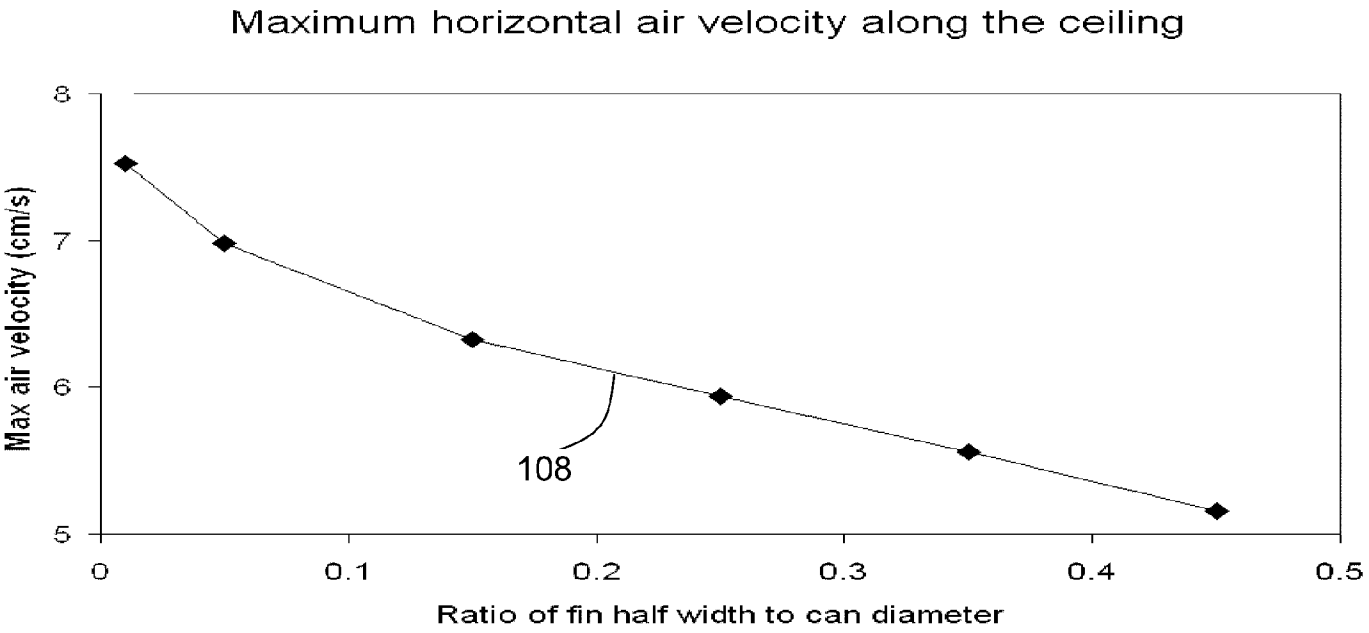
FIG. 15 depicts the maximum horizontal air velocity along the ceiling as a function of the normalized luminaire diameter.

As illustrated in FIGS. 14 and 15, simulations were also performed on a variety of luminaires having a flared heat flange (for example, a heat flange as generally illustrated in FIG. 5) with different flange half-widths r. In particular, FIG. 14 generally illustrates the maximum temperature 104 of the light engine as a function of the ratio of the flange half-width r to diameter of luminaire (normalized by the normalized by the luminaire diameter). Note, that luminaire diameter is equal to 2R. In addition, the maximum temperature 106 of the proximal-most end of the heat flange (i.e., the amount of thermal energy rejected from the heat flange to the air) was also recorded as a function of the normalized luminaire diameter. FIG. 15 generally illustrates maximum horizontal air velocity 108 along the ceiling as a function of the normalized luminaire diameter.

Figure 16:
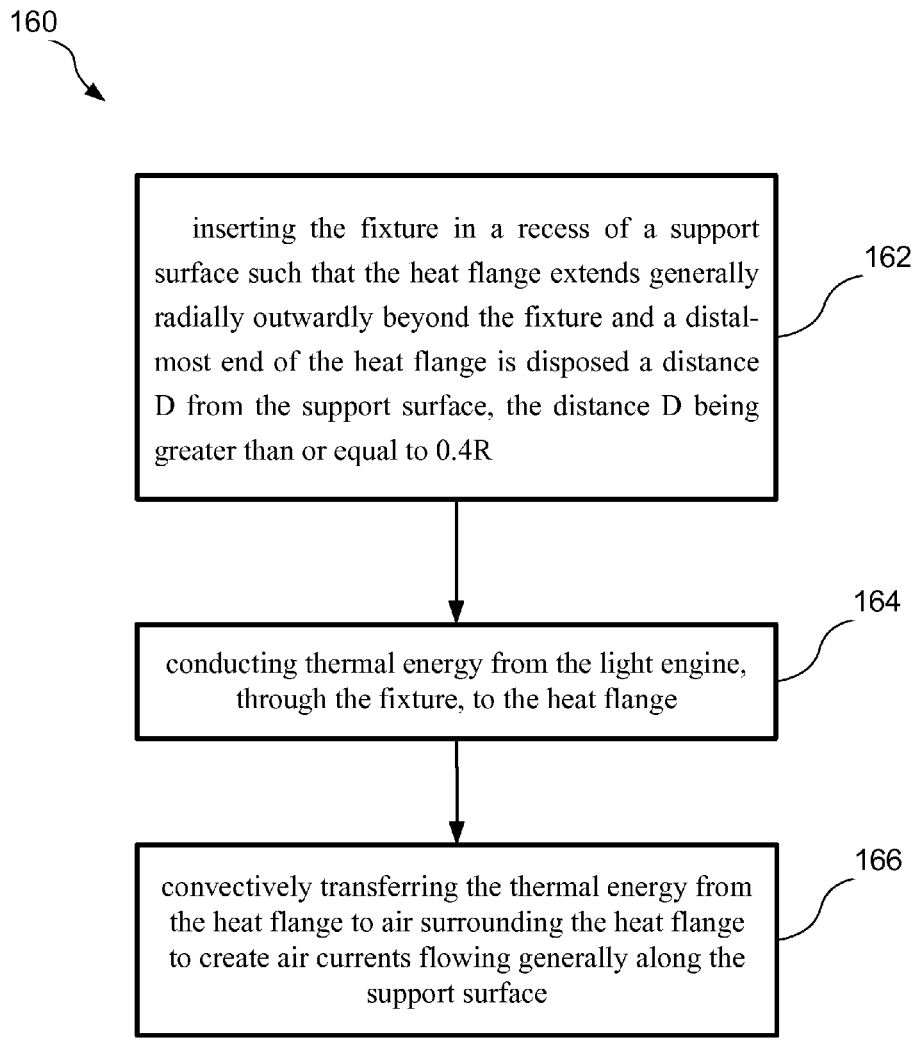
FIG. 16 is a block flow diagram of one exemplary method consistent with the present disclosure.

FIG. 16 is a block flow diagram of one method 160 of reducing the junction temperature of a luminaire consistent with the present disclosure. The luminaire includes a fixture defining a cavity, a light engine, and a heat flange. The fixture is inserted 162 into a recess of a support surface such that the heat flange extends generally radially outwardly beyond the fixture and a distal-most end of the heat flange is disposed a distance D from the support surface, the distance D being greater than or equal to 0.4R. Thermal energy is conducted 164 from the light engine, through the fixture, to the heat flange. The thermal energy is convectively transferred 166 from the heat flange to the air surrounding the heat flange to create air currents flowing generally along the support surface.

While the block flow diagram for FIG. 16 may be shown and described as including a particular sequence of steps. It is to be understood, however, that the sequence of steps merely provides an example of how the general functionality described herein can be implemented. The steps do not have to be executed in the order presented unless otherwise indicated.

Figure 17:
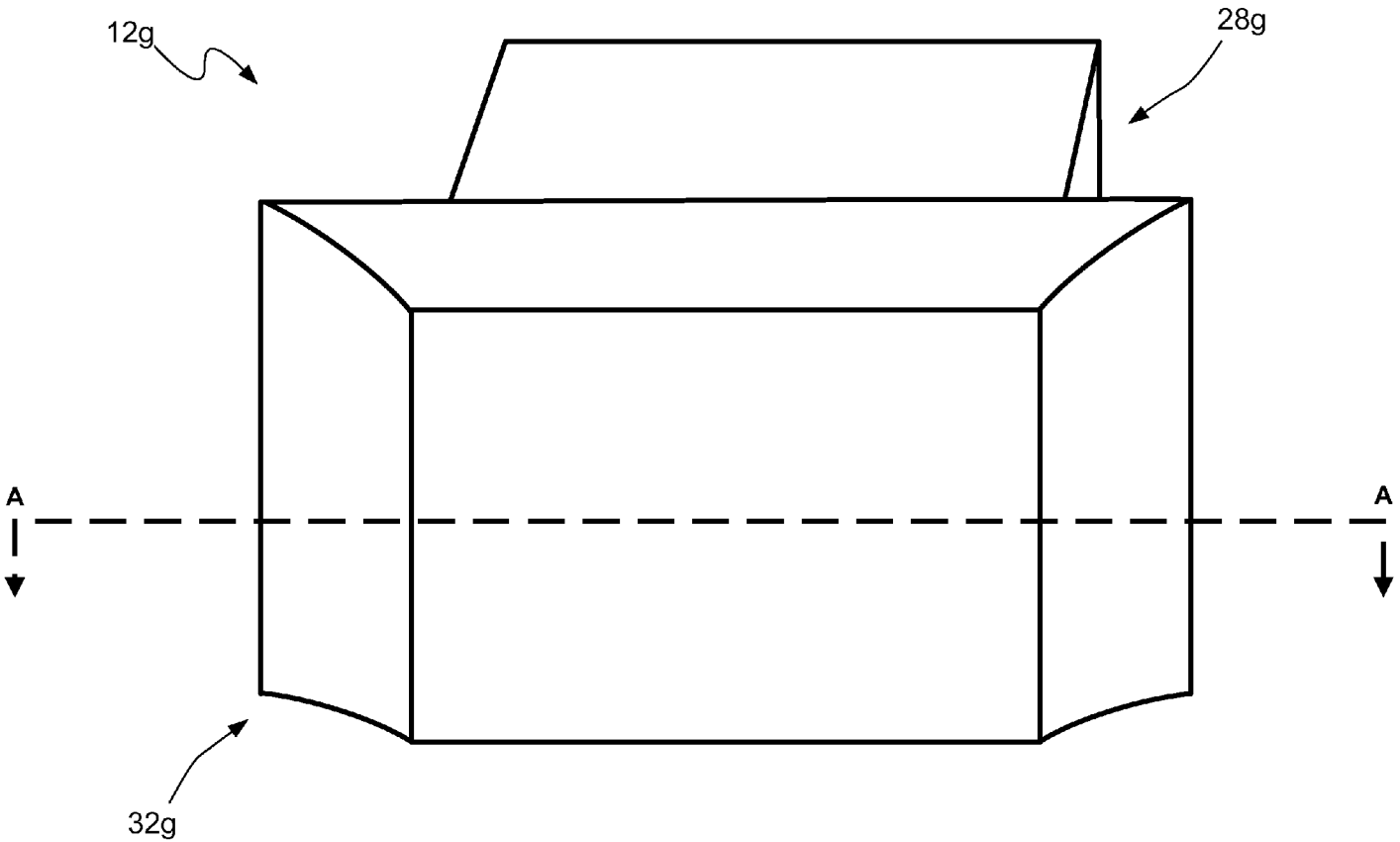
FIG. 17 is a perspective view of one embodiment of a rectangular luminaire consistent with the present disclosure.
Figure 18:
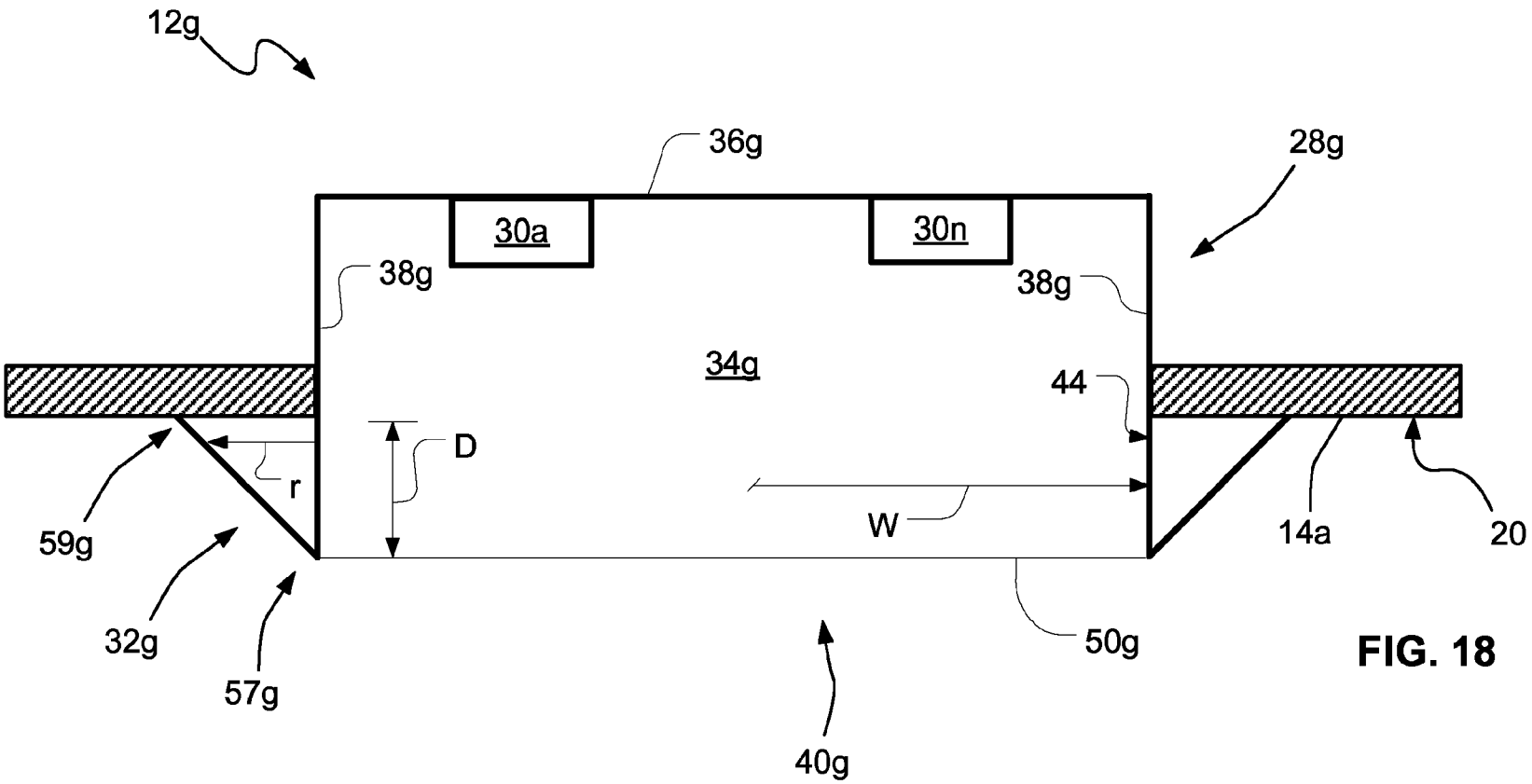
FIG. 18 is a cross-sectional view of the rectangular luminaire of FIG. 17 taken along lines A-A.

Turning now to FIGS. 17 and 18, a generally rectangular luminaire 12*g* is illustrated in which FIG. 18 is a cross-sectional view taken along lines A-A of FIG. 17. In particular, the generally rectangular luminaire 12*g* may include any of the features described herein, except that the generally rectangular luminaire 12*g* includes a heat flange 32*g* disposed around a perimeter of a fixture 28*g* having a generally rectangular cross-section. As used herein, the term "generally rectangular" is intended to mean that the angle between the sides may vary slightly from 90 degrees, for example, +/−10 degrees. The rectangular fixture 28*g* defines at least one cavity 34*g* configured to have an array of light engines 30*a*-30*n*. The rectangular fixture 28*g* has a height, a width, and a length and includes a base 36*g*, four sidewalls 38*g*, and an open end 40*g*. The rectangular luminaire 12*g* may optionally include a lens or diffuser 50*g* as described herein. As used herein, width and the length of the fixture 28*g* refer to cross-sectional distances of the fixture 28*g* in a common plane which is generally parallel to the surface 20 of the ceiling 14*a*, wherein the width is equal to or smaller than the length. In addition, the term "fixture half-width W" is intended to refer to one half of distance of the width.

As discussed above, the rectangular luminaire 12*g* features a heat flange 32*g* disposed around a perimeter of a generally rectangular fixture 28*g*. While the heat flange 32*g* extends along the perimeter of the generally rectangular fixture 28*g*, the heat flange 32*g* may have any configuration consistent with the present disclosure. For example, the heat flange 32*g* may include a hollow, generally pyramidal frustum shape having a generally rectangular cross-section which generally linearly tapers radially outwardly from the distal-most end 57*g* towards the rectangular fixture 28*g*, a curved or flared hollow, generally pyramidal frustum shape having a generally rectangular cross-section. As used herein, the term "generally pyramidal frustum" is intended to mean that the top and base of the pyramid may be, but do not necessarily have to be, parallel to each other. The heat flange 32*g* may optionally include one or more fins as described herein. Further, as noted herein, the heat flange 32*g* may be a separate component which may be secured to the rectangular fixture 28*g* (and may optionally include one or more flanges and/or thermal interface material as described herein), or may be a monolithic component with the rectangular fixture 28*g*. Additionally, the heat flange 32*g* and the rectangular fixture 28*g* may include any materials described herein.

The heat flange 32*g* has a depth D equal to or greater than 0.4 times the fixture half-width W. For example, the depth D may be equal to or greater than 0.6 times the fixture half-width W; equal to or greater than 0.8 times the fixture half-width W; and/or equal to or greater than 1.2 times the fixture half-width W. Alternatively, the depth D of the heat flange 32 may be selected to be greater than or equal to 0.4W and less than or equal to 2W; greater than or equal to 0.4W and less than or equal to 1.4W; greater than or equal to 0.8W and less than or equal to 1.6W; greater than or equal to 0.8W and less than or equal to 1.4W, and/or any value in between. It should be understood that all rectangular luminaires consistent with FIGS. 16-21 and the present disclosure feature heat flanges having the above described relationships between the distance D and the fixture half-width W.

The heat flange 32*g* has a maximum flange half-width r equal to or greater than 0.4 times the fixture half-width W. As used herein, the term "maximum flange half-width r" is intended to refer to the maximum radial distance of the heat flange 32*g*. For example, the maximum flange half-width r may correspond to the radial distance of the heat flange 32*g* at the proximal-most end 59*g* of the heat flange 32*g* configured to be adjacent to the ceiling 14*a* as generally illustrated. The heat flange 32*g* may also have a maximum flange half-width r equal to or greater than the fixture half-width W. It should be understood that all rectangular luminaires consistent with FIGS. 16-21 and the present disclosure feature heat flanges having the above described relationships between the maximum flange half-width r and the fixture half-width W.

Figure 19:
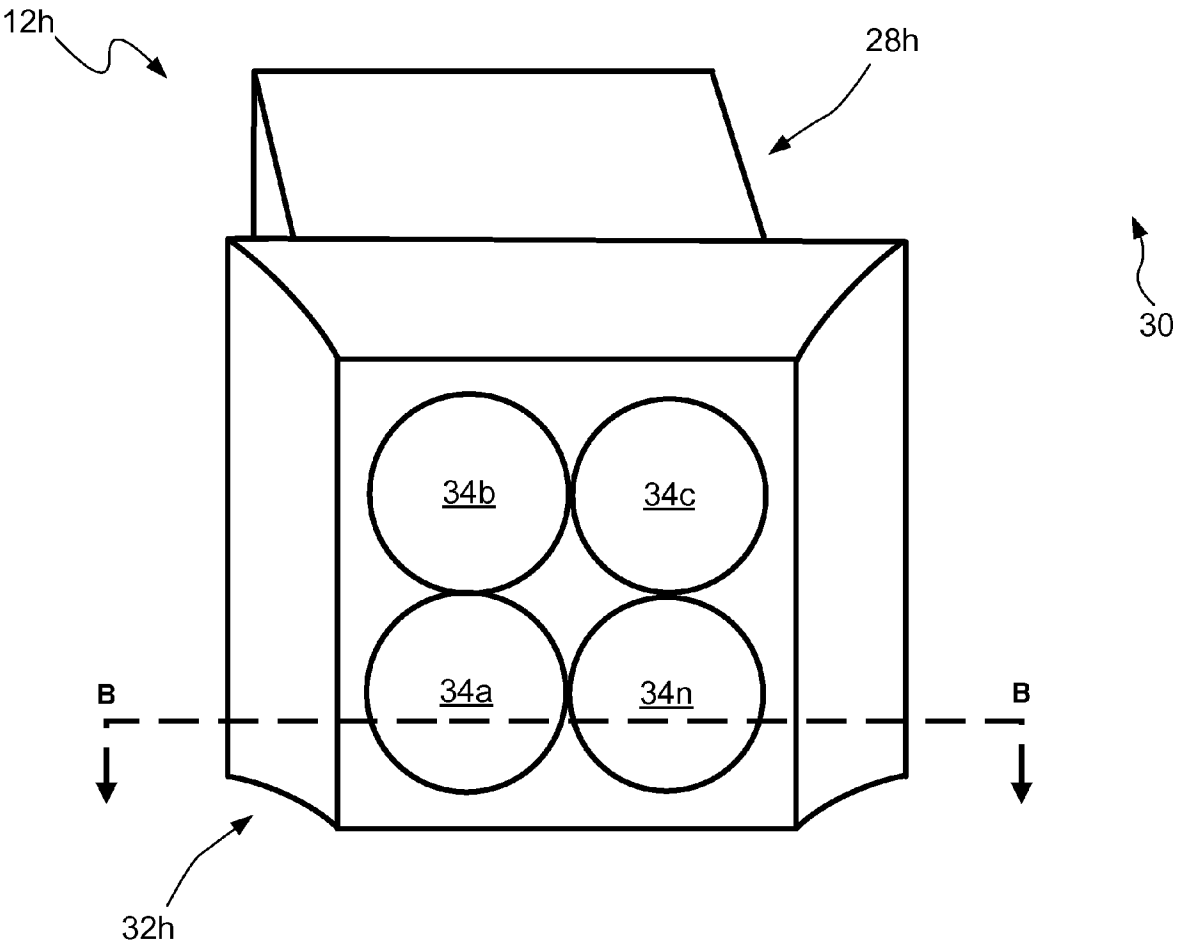
FIG. 19 is a perspective view of another embodiment of a rectangular luminaire consistent with the present disclosure.
Figure 20:
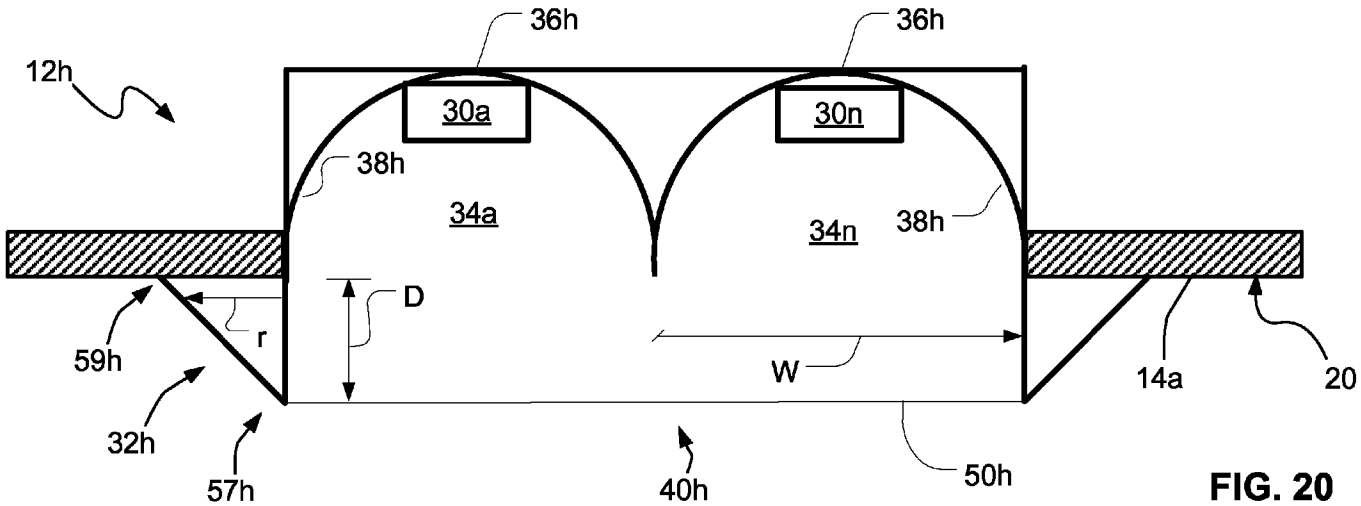
FIG. 20 is a cross-sectional view of the rectangular luminaire of FIG. 19 taken along lines B-B.

As shown in FIG. 18, the rectangular fixture 28*g* defines a single cavity 34*g* containing a plurality of light engines 30*a*-*n*. Alternatively, the rectangular fixture 28*h* may define a plurality of cavities 34*a*-*n* as generally illustrated in FIGS. 19 and 20. In particular, FIG. 20 is a cross-sectional view of the rectangular luminaire 12*g* taken along lines B-B of FIG. 19. Each cavity 34*a*-*n* may include one or more light engines 30*a*-*n*, and may have a generally circular cross-sectional. Each cavity 34*a*-*n* may also feature a reflective surface 44 configured to reflect the light emitted from the light engine 30*a*-*n*.

Figure 21:
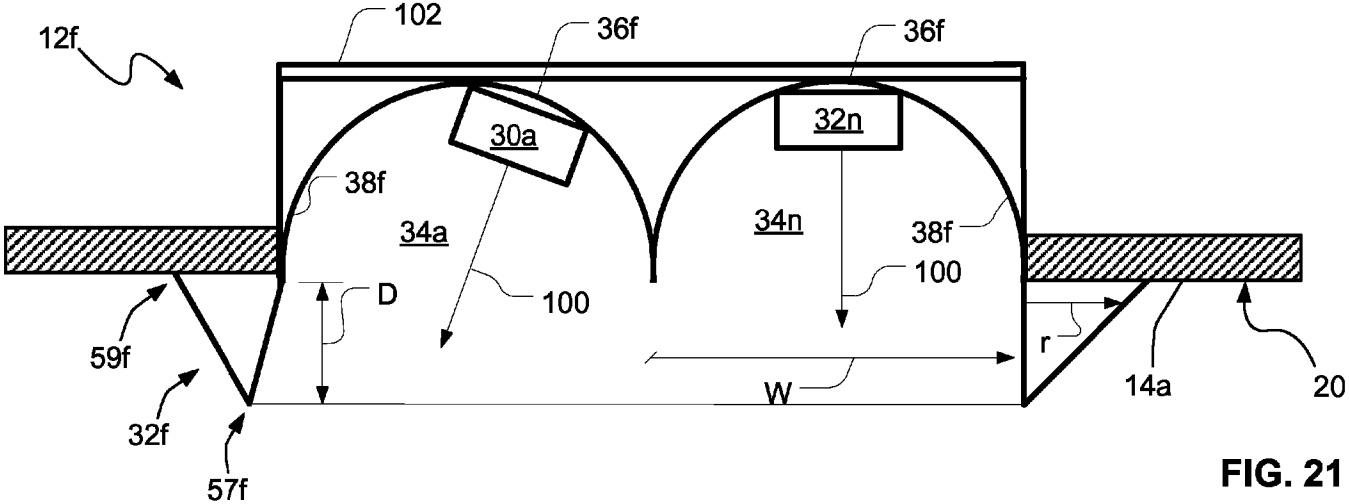
FIG. 21 is a cross-sectional view of yet another embodiment of a rectangular luminaire consistent with the present disclosure.

Turning now to FIG. 21, the rectangular luminaire 12*f* may optionally be configured to allow a user to adjust the position of one or more of the light engines 30*a*-*n*. Such an arrangement allows a user to adjust the illumination pattern (generally illustrated by arrow 100) generated by the rectangular luminaire 12*f*. For example, one or more of the cavities 34*a*-*n* may be coupled to the fixture 28*f* using one or more sliders 102 or the like. The rectangular luminaire 12*f* may therefore be configured to allow a user to adjust the orientation of a cavity 34*a-n* and the associated light engine 30*a-n* with respect to the fixture 28*f*.

While the exact dimension of a rectangular luminaire consistent with the present disclosure may depend upon the intended application, the rectangular luminaire 12*h* may have a generally square fixture 28*h* having a generally square heat flange 32*h*, for example, as illustrated in FIG. 19. For example, the fixture 28*h* may be 2 feet by 2 feet. Alternatively, the rectangular luminaire 12*g* may have a length which is greater than the length, for example, as generally illustrated in FIG. 17. For example, the fixture 28*g* may be 2 feet by 4 feet. It should be understood, however, that the rectangular fixture 28 is not limited to these dimensions unless specifically claimed as such.

Thus, a rectangular luminaire consistent with the present disclosure may reduce the junction temperature. The rectangular luminaire may be particularly useful in applications where vertical convection above the ceiling and/or lateral convection inside the room are suppressed. The rectangular luminaire may also be particularly useful in applications with stagnant or near stagnant air floor within a room. The rectangular luminaire may therefore run at a lower temperature with the same power (i.e., luminance) compared to a flush-mounted luminaire (thus increasing the life-expectancy of the light engine) or at a higher power with the same temperature compared to a flush-mounted luminaire while also maintaining an acceptable service life. A rectangular luminaire may include a generally rectangular fixture, at least one light engine coupled to the fixture, and a heat flange coupled to the fixture. The heat flange is configured to extend below the support surface a distance D, wherein D is greater than or equal to 0.4 times the fixture half-width W.

The present disclosure recognizes that the insulation above a luminaire in a common installation reduces the transfer of thermal energy from the luminaire and may create a bottleneck. The partially-recessed luminaire of the present disclosure reduces and/or eliminates this bottleneck by increasing the surface area of the ceiling which is used to transfer the thermal energy from the luminaire. In particular, the heat flange reduces the junction temperature of the light engine by increasing the amount of convection in the surrounding air, thereby increasing the volumetric air flow across the fixture as well as the air velocity. In particular, thermal energy is conductively transferred from the light engine, through the fixture, to the heat flange where the thermal energy is convectively transferred from the heat flange to surrounding air to create air currents flowing along the support surface. The shape of the heat flange directs the heated air outwardly away from the luminaire and generally along the surface of the support surface. This heated air is then exposed to a greater area of the support surface (i.e., the heat-flow area). Because the cross-sectional area of heat flow through the support surface is so much larger due to the increased air currents generated by the heat flange, the temperature differential required to transfer the thermal energy into the support surface is much smaller. The increased volumetric air flow and velocity transfers a greater amount of thermal energy from the fixture into the surrounding air, thereby reducing the junction temperature of the light engine.

According to one aspect, the present disclosure may feature a rectangular luminaire including a generally rectangular fixture, a plurality of light engines, and a heat flange. The generally rectangular fixture is configured to be generally received in a recess of a support surface. The light engines are configured to be disposed within the fixture and each includes at least one light source. The heat flange is disposed about a distal end region of the generally rectangular fixture and includes a generally conical cross-section extending generally radially outwardly beyond the generally rectangular fixture and extending away from the distal end region of the generally rectangular fixture. A distal-most end of the heat flange is configured to be disposed a distance D from the support surface when the generally rectangular fixture is received in the recess. The distance D being greater than or equal to 0.4W, wherein W is the fixture half-width.

According to another aspect, the present disclosure may feature a rectangular luminaire including generally rectangular fixture, a plurality of light engines, and a heat flange. The generally rectangular fixture is configured to be generally received in a recess of a support surface. The light engines are configured to be disposed within the generally rectangular fixture and each includes at least one light source. The heat flange is disposed about a distal end region of the generally rectangular fixture and includes a generally conical cross-section extending generally radially outwardly beyond the generally rectangular fixture and extending away from the distal end region of the generally rectangular fixture. A distal-most end of the heat flange is configured to be disposed a distance D from the support surface when the generally rectangular fixture is received in the recess, the distance D being greater than or equal to 0.4W, wherein W is the fixture half-width. The heat flange also has a maximum flange half-width r equal to or greater than 0.4 W.

The terms "first," "second," "third," and the like herein do not denote any order, quantity, or importance, but rather are used to distinguish one element from another, and the terms "a" and "an" herein do not denote a limitation of quantity, but rather denote the presence of at least one of the referenced item.

While the principles of the present disclosure have been described herein, it is to be understood by those skilled in the art that this description is made only by way of example and not as a limitation as to the scope of the invention. The features and aspects described with reference to particular embodiments disclosed herein are susceptible to combination and/or application with various other embodiments described herein. Such combinations and/or applications of such described features and aspects to such other embodiments are contemplated herein. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A rectangular luminaire comprising:

a generally rectangular fixture configured to be generally received in a recess of a support surface;

a plurality of light engines configured to be disposed within said generally rectangular fixture, said light engines each comprising at least one light source; and a heat flange disposed about a distal end region of said generally rectangular fixture, said heat flange having a hollow, generally pyramidal frustum shape with a generally rectangular cross-section extending generally radially outwardly beyond said generally rectangular fixture and extending away from said distal end region of said generally rectangular fixture, wherein a distal-most end of said heat flange is configured to be disposed a distance D from said support surface when said generally rectangular fixture is received in said recess, said distance D being greater than or equal to 0.4W, wherein W is the fixture half-width.

2. The rectangular luminaire of claim 1, wherein said generally conical cross-section of said heat flange generally linearly tapers radially outwardly from a proximal end region of the heat flange to said distal-most end of said heat flange.

3. The rectangular luminaire of claim 1, wherein said heat flange has a curved, generally conical cross-section.

4. The rectangular luminaire of claim 3, wherein said curved, generally conical cross-section is concaved.

5. The luminaire of claim 3, wherein said curved, generally conical cross-section is convex.

6. The rectangular luminaire of claim 1, wherein said heat flange further comprises at least one fin extending generally outwardly from said heat flange.

7. The rectangular luminaire of claim 1, wherein said fixture and said heat flange is a monolithic component.

8. The rectangular luminaire of claim 1, wherein said heat flange is removably secured to said fixture.

9. The rectangular luminaire of claim 1, wherein said generally rectangular fixture comprises a plurality of cavities, said cavities each having at least one light engine.

10. The rectangular luminaire of claim 9, wherein a light engine associated with at least one of said cavities moveable with respect to said generally rectangular fixture.

11. The rectangular luminaire of claim 9, wherein at least one of said cavities has a generally circular cross-section.

12. The rectangular luminaire of claim 1, wherein said distance D is greater than or equal to 0.6W.

13. The rectangular luminaire of claim 1, wherein said distance D is greater than or equal to 0.8W.

14. The rectangular luminaire of claim 1, wherein said distance D is less than or equal to 2W.

15. The rectangular luminaire of claim 1, wherein said light engine comprises at least one light emitting diode.

16. The rectangular luminaire of claim 1, wherein said light engine is coupled to a base region of said cavity.

17. A rectangular luminaire comprising:

a generally rectangular fixture configured to be generally received in a recess of a support surface;

a plurality of light engines configured to be disposed within said generally rectangular fixture, said light engines each comprising at least one light source; and a heat flange disposed about a distal end region of said generally rectangular fixture, said heat flange having a hollow, generally pyramidal frustum shape with a generally rectangular cross-section extending generally radially outwardly beyond said generally rectangular fixture and extending away from said distal end region of said generally rectangular fixture;

wherein a distal-most end of said heat flange is configured to be disposed a distance D from said support surface when said generally rectangular fixture is received in said recess, said distance D being greater than or equal to 0.4W, wherein W is the fixture half-width; and wherein said heat flange has a maximum flange half-width r equal to or greater than 0.4 W.

18. The rectangular luminaire of claim 17, wherein said generally rectangular fixture comprises a plurality of cavities, said cavities each having at least one light engine.

19. The rectangular luminaire of claim 17, wherein said light engine comprises at least one light emitting diode.

20. The rectangular luminaire of claim 19, wherein at least one of said cavities has a generally circular cross-section.

* * * * *